US008530377B2

(12) United States Patent
Tsuchimura et al.

(10) Patent No.: US 8,530,377 B2
(45) Date of Patent: Sep. 10, 2013

(54) THERMOREVERSIBLE RECORDING MEDIUM, AND THERMOREVERSIBLE RECORDING MEMBER

(75) Inventors: Yu Tsuchimura, Shizuoka (JP); Satoshi Arai, Shizuoka (JP); Jun Maruyama, Kanagawa (JP); Yutaka Matsuoka, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 246 days.

(21) Appl. No.: 12/956,417

(22) Filed: Nov. 30, 2010

(65) Prior Publication Data

US 2011/0130280 A1 Jun. 2, 2011

(30) Foreign Application Priority Data

Dec. 1, 2009 (JP) ..... 2009-273828

(51) Int. Cl.
*B41M 5/42* (2006.01)

(52) U.S. Cl.
USPC ..... 503/201; 503/207; 503/226

(58) Field of Classification Search
None
See application file for complete search history.

(56) References Cited

U.S. PATENT DOCUMENTS

| | | | | |
|---|---|---|---|---|
| 5,296,439 | A | 3/1994 | Maruyama et al. | |
| 6,004,899 | A * | 12/1999 | Tachizawa | 503/207 |
| 2009/0029854 | A1 | 1/2009 | Maruyama et al. | |
| 2009/0048106 | A1 | 2/2009 | Shimbo et al. | |
| 2009/0239747 | A1 | 9/2009 | Morita et al. | |
| 2010/0061198 | A1 | 3/2010 | Kawahara et al. | |

FOREIGN PATENT DOCUMENTS

| | | |
|---|---|---|
| CN | 101512401 | 8/2009 |
| JP | 5-124360 | 5/1993 |
| JP | 6-1066 | 1/1994 |
| JP | 9-175024 | 7/1997 |
| JP | 10-203016 | 8/1998 |
| JP | 2981558 | 9/1999 |
| JP | 3501430 | 12/2003 |
| JP | 3504035 | 12/2003 |
| JP | 3549131 | 4/2004 |
| JP | 3596706 | 9/2004 |
| JP | 2006-82252 | 3/2006 |
| JP | 2006-88445 | 4/2006 |
| JP | 4125986 | 5/2008 |
| JP | 2009-28911 | 2/2009 |
| JP | 2009-126072 | 6/2009 |
| JP | 2103445 A1 | 9/2009 |

OTHER PUBLICATIONS

Mar. 18, 2011 European search report in connection with counterpart European patent application No. 10 25 2039.
Chinese official action dated Mar. 20, 2013 (including English translation) in corresponding Chinese patent application No. 2010 01 57 6221.5.

* cited by examiner

*Primary Examiner* — Bruce H Hess
(74) *Attorney, Agent, or Firm* — Cooper & Dunham LLP

(57) ABSTRACT

The present invention provides a thermoreversible recording medium which includes a support, a thermoreversible recording layer which comprises a thermoreversible composition containing an electron-donating color-forming compound and an electron-accepting compound, a metal compound-containing layer which includes a resin, an organic metal compound, and an inorganic layer compound, in which the resin is at least one selected from the group consisting of polyvinyl alcohol polymers, and ethylene-vinyl alcohol copolymers, and the organic metal compound is at least one selected from the group consisting of an organic titanium compound and an organic zirconium compound, and a protective layer which protects the metal compound-containing layer, wherein the support, the thermoreversible recording layer, the metal compound-containing layer and the protective layer are laminated in this order.

14 Claims, 4 Drawing Sheets

THERMOREVERSIBLE RECORDING MEDIUM, AND THERMOREVERSIBLE RECORDING MEMBER

BACKGROUND OF THE INVENTION

1. Field of the Invention

The present invention relates to a thermoreversible recording medium and a thermoreversible recording member having the thermoreversible recording medium.

2. Description of the Related Art

Thermosensitive recording media utilizing a color-forming reaction between an electron-donating color-forming compound (which may be referred to as "color former" hereinbelow) and an electron-accepting compound (which may be referred to as "developer" hereinbelow) have been widely known and widely utilized as output paper for facsimiles, word processors, and scientific instruments, with the progress of office automation. In addition, they are also widely used as commutation tickets for transportation means, magnetic cards (e.g., various pre-paid cards, and loyalty point cards), IC cards, and IC tags. In particular, recently, from the viewpoint of environmental problems and waste generation, developments of cards, tags and labels utilizing a thermoreversible recording medium, which is rewritable any number of times, have been a focus of attention.

Hereinafter, the principle of reversible coloring/decoloring thermoreversible recording medium will be simply described. A typical thermoreversible recording medium includes a film-shaped, sheet-shaped or plate-shaped support (such as paper, and a plastic card) and a thermosensitive recording layer formed on a surface of the support, wherein the thermosensitive recording layer is made of a composition in which a color former and a developer are mixed with and dispersed in a binder such as a thermoplastic resin. In the composition containing a color former and a developer contained in the thermosensitive recording layer, when the color former and developer are merely mixed in a solid state, the thermosensitive recording layer does not develop a color. However, when the composition is raised in high temperature, the whole of the composition is in a molten state, and the color former and developer contained in the thermosensitive recording layer react to develop a color. When the composition in a molten state is slowly cooled, the color former and developer dissociate in the vicinity of their melting temperature and are individually agglomerated or crystallized and then erase the color. Then, this state is changed into a frozen state by the solidification of the thermoplastic resin etc. as a binder. However, when the molten composition forming a color is rapidly cooled, the thermoplastic resin is solidified before the dissociation of the color former and developer takes place, and a reaction product between the color former and the developer sometimes comes into a frozen state with its colored state kept. By selecting a composition obtained in a combination of a binder and two types of compounds which have a proper melting temperature and a freezing temperature and bring about such a phenomenon, it is possible to select coloring or decoloring by controlling the cooling speed of the composition after being heated and melted and to maintain each of the colored state and the colored state of the composition in a frozen state, at normal temperature.

FIG. 6 illustrates a graph of temporal changes of coloring—decoloring with respect to a change in temperature of the thermosensitive recording medium. In FIG. 6, the horizontal axis represents passing time, and the vertical axis represents a temperature. T1 represents a melting-coloring reaction temperature of a color former and a developer and T2 represents a temperature of a composition containing the color former and developer and a binder is in a solid and frozen state. In other words, in the temperature range between T1 and T2, it is possible to dissociate the color former from the developer in a reaction product of the color former and developer contained in the colored composition and to agglomerate or crystallize each of them. However, it takes some reaction time for the reaction product to dissociate the color former from the developer to be agglomerated or crystallized individually.

In the graph illustrated in FIG. 6, the composition, which is, at the beginning, in a state (a) (a colored state) at normal temperature, is heated to the temperature T1. The composition is melted during a time span t1 when the temperature is T1, however, it maintains its colored state (b). This composition is slowly cooled to the temperature T2 for a time span t2 and then restored to normal temperature. Since the time t2 is longer than the time in which the color former and the developer in the reaction product in a melted and colored state dissociate from each other and then each of them are agglomerated or crystallized, the reaction product is in a dissociated state before it is in a solid and frozen state, and at normal temperature, it is frozen with a decolored state (c).

When the composition in a decolored state is heated again to be a molten state (d), the color former and developer in the composition are melted and reacted to develop a color. When this composition is rapidly cooled to normal temperature for a short time span t4, the composition is restored to normal temperature in a state (e) where the reacted molecules are frozen, and remains in the colored state.

When the composition in the state (e) is exposed in the dissociation and crystallization temperature range between the molten temperature T1 and T2 for a long time span t5 (state (f)), the reaction product dissociates into the color former and the developer, and each of them may be agglomerated or crystallized to be in a decolored state. In this case, when the composition is restored to normal temperature, it also remains in a decolored state (g). When the above-mentioned phase change of the composition is utilized, it is possible to make the composition develop a color or decolored by controlling the heating temperature, cooling temperature, cooling speed, and the like. Note that in the graph, the temperature space between T1 and T2 is schematically illustrated, but this temperature space for the composition, it is actually selected from several degrees Celsius to about 10° C.

Japanese Patent (JP-B) No. 2981558 proposes a thermoreversible color-forming composition as a developer, in which an organic phosphoric acid compound having a long-chain fatty acid hydrocarbon group and an aliphatic carboxylic acid compound or a phenol compound is used in combination with a leuco dye as a color former, and to proposes a thermoreversible recording medium using the thermoreversible color-forming composition. JP-B No. 2981558 describes that this thermoreversible recording medium enables coloring and decoloring with ease by controlling heating conditions, enables stably maintaining the colored state and decolored state at normal temperature and further enables repeating of the coloring and decoloring.

In principle, a thermoreversible recording medium may only have a thermosensitive recording layer capable of repeatedly performing the above-mentioned coloring and decoloring. However, in the thermoreversible recording medium disclosed in JP-B No. 2981558, the leuco dye used in the thermoreversible recording layer sometimes fades in color at its colored portions or discolors at its non-colored portions (decolored portions), impairing the whiteness due to being exposed to light. Particularly, most leuco dyes for use as color formers cause a radical reaction with oxygen, in an activated state by light. The color fading and discoloration of a thermoreversible recording are considered to be involved in the interaction of a slight amount of oxygen. When a leuco dye is reacted with oxygen to cause a radical reaction, a thermosensitive recording layer in a colored state may be decolored or fade in color, and a thermosensitive recording layer in a decolored state may be colored (turn yellow, for example).

As a method of resolving the above-mentioned color fading of colored portions and discoloration of non-colored portions, Japanese Patent (JP-B) Nos. 3501430 and 3504035 propose a thermoreversible recording medium, in which a thermosensitive recording layer containing a leuco dye having a relatively large resistance to exposure to light is coated with a gas barrier layer capable of blocking oxygen and made of a polymer resin. Further, Japanese Patent (JP-B) Nos. 3549131, 3596706, and Japanese Patent Application Laid-Open (JP-A) No. 06-1066 propose to add antioxidants such as α-tocopherol and vitamins to a gas barrier layer made of a high-molecular resin. With these improvement methods, there were effects of preventing color fading of color-formed images and keeping the degree of whiteness thereof. However, when a thermoreversible recording medium is used for a long time and heating/cooling process is repeated for recording and erasing an image, there was a problem that damage accumulate on a gas barrier-high-molecular film, and the gas barrier layer provided for coating the thermoreversible recording medium peeled off, resulting in impairment of the gas barrier function.

As a method of preventing the peel-off (separation) of a gas barrier layer, Japanese Patent Application Laid-Open (JP-A) No. 09-175024, 2006-82252 and 2006-88445 propose to provide an adhesive layer made of a water-soluble resin and the like between a thermosensitive recording layer and a gas barrier layer, and propose to add a specific adhesive to a gas barrier layer for improving the properties of the bonded surface. With these methods, relatively favorable improving effects are observed.

As described above, a thermoreversible recording medium is commonly provided with a gas barrier layer for insulation of oxygen. A gas barrier layer is produced by film forming a typical synthetic polymer resin having gas barrier properties. Among synthetic polymer resins, polyvinyl alcohol (PVA) resins have characteristics that are flexible and non-electrically charged and are excellent in the gas barrier properties in a dried state. However, PVA resins have high affinity with moistures, and when they are formed in a gas barrier film, the dependency on humidity of the gas barrier function is large, and the gas barrier properties thereof may significantly degrade or the gas barrier film may peel off under high-humidity conditions. When peel-off of a gas barrier film occurs, not only the gas barrier properties considerably degrade but also the peeled portion becomes a light reflection surface. As a result, the gas barrier film looks white, and a recorded image may be sometimes masked.

To solve the problem with hygroscopicity of PVA resins, there has been known to make them have water resistance by chemical modification, such as by acetalizing a hydroxyl group of PVA, however, the hydrogen-bonding force of a hydroxyl group, which is the gas barrier-exhibiting mechanism of PVA, degrades, impairing the inherent gas barrier properties thereof, although provision of water resistance to PVA is realized. In addition, ethylene-vinyl alcohol (EVOH)-based copolymers serving as a medium having a gas barrier function are more excellent in water resistance than PVA, however, are poor in hydrogen bonding force than PVA, and thus sufficient gas barrier properties cannot be maintained under high-humidity conditions.

In the light of the above-mentioned problems, as a thermoreversible recording medium causing no color fading and a change of the base portion thereof due to exposure to light even when exposed to high-humidity conditions, there has been known a reversible thermosensitive recording medium which includes a thermoreversible recording layer made of a reversible thermosensitive composition containing a mixture of an electron-donating color-forming compound and an electron-accepting compound, and a gas barrier layer containing at least one gas barrier resin selected from the group consisting of polyvinyl alcohol polymers and ethylene-vinyl alcohol copolymer, wherein the reversible thermosensitive recording layer and the gas barrier layer are laminated in this order (for example, see Japanese Patent Application Laid-Open (JP-A) No. 2009-28911), however, the thermoreversible recording medium has problems that the inner-layer adhesion of the gas barrier layer and the adhesion between the gas barrier layer and other layers are inferior, and when inner-layer separation of the gas barrier layer and interlayer separation between the gas barrier layer and other layers occur.

As described above, a thermoreversible recording medium capable of maintaining a high-definition recorded image without causing inner-layer separation of a gas barrier layer and interlayer separation between the gas barrier layer and other layers has not yet been found out so fat.

BRIEF SUMMARY OF THE INVENTION

The present invention aims to solve the above-mentioned convention problems and to achieve the following object. That is, an object of the present invention is to provide a thermoreversible recording medium capable of preventing the occurrence of inner-layer separation of a metal compound-containing layer and interlayer separation between a gas barrier layer and other layers and capable of maintaining a high-definition recorded image even when used for a long time under strict environmental conditions, and also provide a thermoreversible recording member having the thermoreversible recording medium.

Means for solving the above-mentioned problems are as follows:

<1> A thermoreversible recording medium including:

a support, a thermoreversible recording layer which includes a thermoreversible composition containing an electron-donating color-forming compound and an electron-accepting compound, a metal compound-containing layer which includes a resin, an organic metal compound, and an inorganic layer compound, in which the resin is at least one selected from the group consisting of polyvinyl alcohol polymers, and ethylene-vinyl alcohol copolymers, and the organic metal compound is at least one selected from the group consisting of an organic titanium compound and an organic zirconium compound, and a protective layer which protects the metal compound-containing layer, wherein the support, the thermoreversible recording layer, the metal compound-containing layer and the protective layer are laminated in this order.

<2> The thermoreversible recording medium according to <1> above, wherein the amount of metal contained in the metal compound-containing layer is 0.1% by mass to 15% by mass.

<3> The thermoreversible recording medium according to one of <1> and <2> above, wherein the metal compound-containing layer has a thickness of 0.1 μm to 10 μm.

<4> The thermoreversible recording medium according to any one of <1> to <3> above, wherein the organic metal compound contains at least one of a chelate compound and an acylate compound.

<5> The thermoreversible recording medium according to any one of <1> to <4> above, further including: a thermosetting resin-containing layer between the metal compound-containing layer and the protective layer, wherein the thermosetting resin-containing layer contains a hardened material made of a thermosetting resin composition.

<6> The thermoreversible recording medium according to any one of <1> to <5> above, further including: an undercoat layer between the support and the thermoreversible recording layer.

<7> A thermoreversible recording member including:

an information storage unit, and a reversible display unit, wherein the reversible display unit includes the thermoreversible recording medium according to any one of <1> to <6> above.

<8> The thermoreversible recording member according to <7> above, wherein the information storage unit includes at least one selected from a magnetic thermosensitive recording layer, a magnetic stripe, an IC memory, an optical memory, a hologram, an RF-ID tag card, a disk, a disk cartridge, and a tape cassette.

The present invention can solve the above-mentioned conventional problems, achieve the above object, and provide a thermoreversible recording medium capable of preventing the occurrence of inner-layer separation of a metal compound-containing layer and interlayer separation between a gas barrier layer and other layers and capable of maintaining a high-definition recorded image even when used for a long time under strict environmental conditions, and also provide a thermoreversible recording member having the thermoreversible recording medium.

Figure 1:
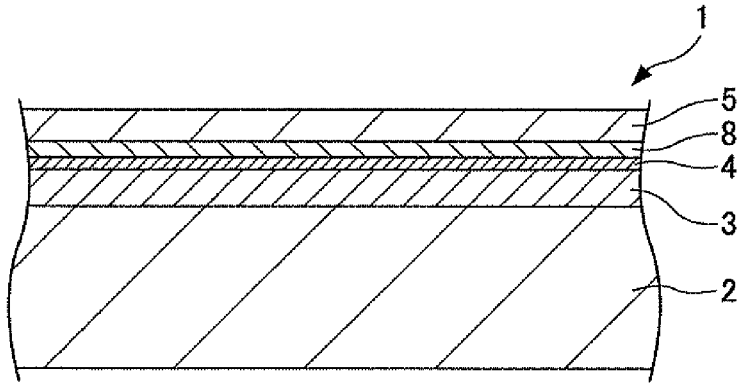
FIG. 1 is a partially cross-sectional view schematically illustrating a thermoreversible recording medium according to the present invention (first).

DETAILED DESCRIPTION OF THE INVENTION (Thermoreversible Recording Medium)

A thermoreversible recording medium according to the present invention includes at least a support, a thermoreversible recording layer, a metal compound-containing layer (gas-barrier layer) and a protective layer, includes a thermosetting resin-containing layer (primer layer), an anchor layer, an undercoat layer, an ultraviolet absorbing layer, and if necessary, includes other layers.

<Support>

The support is not particularly limited, as long as it can support the after-mentioned thermoreversible recording layer, and may be suitably selected in accordance with the intended use. Examples thereof include paper, sheets and films (e.g., resin films, and PET films), synthetic paper, metal foil, glass, and complexes thereof.

The thickness of the support is not particularly limited and may be suitably selected in accordance with the intended use, however, a thickness with which the thermoreversible recording layer can be prevented from oxygen and moistures (an arbitrary thickness of about several micrometers to about several millimeters) is preferable. For example, in the case of a PET film, the thickness is preferably 10 μm or more, more preferably 30 μm or more, and particularly preferably 50 μm or more.

As the support, supports having a necessary thickness may be singularly used or bonded to each other, and the support may include a magnetic recording layer and an IC chip on the same surface on which a thermoreversible recording layer is formed, on the opposite surface, and inside thereof. When the thermoreversible recording layer is self-supportable, the use of the support can be omitted.

The support preferably has oxygen barrier properties and water barrier properties. Here, when the support has inadequate oxygen barrier properties and water barrier properties, the support may be coated with the after-mentioned metal compound-containing layer (gas barrier layer).

Since, generally, a supports is a relatively heavy weight film or sheet, an oxygen blocking function and a water-blocking function are sufficiently provided thereto. When a support does not have the oxygen blocking function and water-blocking function, the support side may be coated with the after-mentioned gas barrier.

<Thermoreversible Recording Layer>

The thermoreversible recording layer (which may be referred to as "thermosensitive recording layer" simply) is not particularly limited, as long as it is made of a thermoreversible composition containing an electron-donating color-forming compound and an electron-accepting compound, and may be suitably selected in accordance with the intended use.

The thermoreversible recording layer is made of a composition containing a mixture of an electron-donating color-forming compound capable of changing in color tone depending on a heating temperature and/or a difference in cooling speed after heating, and an electron-accepting compound. The thermoreversible recording medium reversibly forms a color and erases the color, and can develop a color and erase the color depending on a change in temperature. The composition contains a resin serving as a binder and causes a change between coloring/decoloring and freezing of a color former depending on melting and solidifying of the resin.

<<Electron-Donating Color-Forming Compound>>

The electron-donating color-forming compound (color former) is not particularly limited and may be suitably selected in accordance with the intended use. Examples thereof include colorless or lightly colored dye precursor (leuco dyes), fluoran compounds, triphenylmethane phthalide compounds, azaphthalide compounds, phenothiazine compounds, leucoramine compounds, indolinophthalide compounds.

The fluoran compounds are not particularly limited and may be suitably selected in accordance with the intended use. Specific examples thereof include 2-anilino-3-methyl-6-diethylaminofluoran, 2-anilino-3-methyl-6-di(n-butylamino)fluoran,
2-anilino-3-methyl-6-(N-n-propyl-N-methylamino)fluoran,
2-anilino-3-methyl-6-(N-isopropyl-N-methylamino)fluoran,
2-anilino-3-methyl-6-(N-isobutyl-N-methylamino)fluoran,
2-anilino-3-methyl-6-(N-n-amyl-N-methylamino)fluoran,
2-anilino-3-methyl-6-(N-sec-butyl-N-methylamino)fluoran,
2-anilino-3-methyl-6-(N-n-amyl-N-ethylamino)fluoran,
2-anilino-3-methyl-6-(N-iso-amyl-N-ethylamino)fluoran,
2-anilino-3-methyl-6-(N-n-propyl-N-isopropylamino)fluoran,
2-anilino-3-methyl-6-(N-cyclohexyl-N-methylamino)fluoran,
2-anilino-3-methyl-6-(N-ethyl-p-toluidino)fluoran,
2-anilino-3-methyl-6-(N-methyl-p-toluidino)fluoran,
2-(m-trichloromethylanilino)-3-methyl-6-diethylaminofluoran,
2-(m-trifluoromethylanilino)-3-methyl-6-diethylaminofluoran,
2-(m-trichloromethylanilino)-3-methyl-6-(N-cyclohexyl-N-methylamino)fluoran,
2-(2,4-dimethylanilino)-3-methyl-6-diethylaminofluoran,
2-(N-ethyl-p-toluidino)-3-methyl-6-(N-ethylanilino)fluoran,
2-(N-ethyl-p-toluidino)-3-methyl-6-(N-propyl-p-toluidino)fluoran,
2-anilino-6-(N-n-hexyl-N-ethylamino)fluoran,
2-(o-chloroanilino)-6-diethylaminofluoran,
2-(o-chloroanilino)-6-dibutylaminofluoran,
2-(m-trifluoromethylanilino)-6-diethylaminofluoran,
2,3-dimethyl-6-dimethylaminofluoran,
3-methyl-6-(N-ethyl-p-toluidino)fluoran, 2-chloro-6-diethylaminofluoran,
2-bromo-6-diethylaminofluoran, 2-chloro-6-dipropylaminofluoran,
3-chloro-6-cyclohexylaminofluoran, 3-bromo-6-cyclohexylaminofluoran,
2-chloro-6-(N-ethyl-N-isoamylamino)fluoran,
2-chloro-3-methyl-6-diethylaminofluoran,
2-anilino-3-chloro-6-diethylaminofluoran,
2-(o-chloroanilino)-3-chloro-6-cyclohexylaminofluoran,
2-(m-trifluoromethylanilino)-3-chloro-6-diethylaminofluoran,
2-(2,3-dichloroanilino)-3-chloro-6-diethylaminofluoran,
1,2-benzo-6-diethylaminofluoran, and
3-diethylamino-6-(m-trifluoromethylanilino)fluoran.

Examples of the azaphthalide compounds include 3-(1-ethyl-2-methylindol-3-yl)-3-(2-ethoxy-4-diethylaminophenyl)-4-azaphthalide,
3-(1-ethyl-2-methylindol-3-yl)-3-(2-ethoxy-4-diethylaminophenyl)-7-azaphthalide,
3-(1-octyl-2-methylindol-3-yl)-3-(2-ethoxy-4-diethylaminophenyl)-4-azaphthalide,
3-(1-ethyl-2-methylindol-3-yl)-3-(2-methyl-4-diethylaminophenyl)-4-azaphthalide,
3-(1-ethyl-2-methylindol-3-yl)-3-(2-methyl-4-diethylaminophenyl)-7-azaphthalide,
3-(1-ethyl-2-methylindol-3-yl)-3-(4-diethylaminophenyl)-4-azaphthalide,
3-(1-ethyl-2-methylindol-3-yl)-3-(4-N-n-amyl-N-methylaminophenyl)-4-azaphthalide,
3-(1-methyl-2-methylindol-3-yl)-3-(2-hexyloxy-4-diethylaminophenyl)-4-azaphthalide,
3,3-bis(2-ethoxy-4-diethylaminophenyl)-4-azaphthalide, and
3,3-bis(2-ethoxy-4-diethylaminophenyl)-7-azaphthalide.

Examples of the leuco dyes include 2-(p-acetylanilino)-6-(N-n-amyl-N-n-butylamino)fluoran,
2-benzylamino-6-(N-ethyl-p-toluidino)fluoran,
2-benzylamino-6-(N-methyl-2,4-dimethylanilino)fluoran,
2-benzylamino-6-(N-ethyl-2,4-dimethylanilino)fluoran,
2-benzylamino-6-(N-methyl-p-toluidino)fluoran,
2-benzylamino-6-(N-ethyl-p-toluidino)fluoran,
2-(di-p-methylbenzylamino)-6-(N-ethyl-p-toluidino)fluoran,
2-(α-phenylethylamino)-6-(N-ethyl-p-toluidino)fluoran,
2-methylamino-6-(N-methylanilino)fluoran,
2-methylamino-6-(N-ethylanilino)fluoran,
2-methylamino-6-(N-propylanilino)fluoran,
2-ethylamino-6-(N-methyl-p-toluidino)fluoran,
2-methylamino-6-(N-methyl-2,4-dimethylanilino)fluoran,
2-ethylamino-6-(N-ethyl-2,4-dimethylanilino)fluoran,
2-dimethylamino-6-(N-methylanilino)fluoran,
2-dimethylamino-6-(N-ethylanilino)fluoran,
2-diethylamino-6-(N-methyl-p-toluidino)fluoran,
2-diethylamino-6-(N-ethyl-p-toluidino)fluoran,
2-dipropylamino-6-(N-methylanilino)fluoran,
2-dipropylamino-6-(N-ethylanilino)fluoran,
2-amino-6-(N-methylanilino)fluoran, 2-amino-6-(N-ethylanilino)fluoran,
2-amino-6-(N-propylanilino)fluoran,
2-amino-6-(N-methyl-p-toluidino)fluoran,
2-amino-6-(N-ethyl-p-toluidino)fluoran,
2-amino-6-(N-propyl-p-toluidino)fluoran,
2-amino-6-(N-methyl-p-ethylanilino)fluoran,
2-amino-6-(N-ethyl-p-ethylanilino)fluoran,
2-amino-6-(N-propyl-p-ethylanilino)fluoran,
2-amino-6-(N-methyl-2,4-dimethylanilino)fluoran,
2-amino-6-(N-ethyl-2,4-dimethylanilino)fluoran,
2-amino-6-(N-propyl-2,4-dimethylanilino)fluoran,
2-amino-6-(N-methyl-p-chloroanilino)fluoran,
2-amino-6-(N-ethyl-p-chloroanilino)fluoran,
2-amino-6-(N-propyl-p-chloroanilino)fluoran,
1,2-benzo-6-(N-ethyl-N-isoamylamino)fluoran,
1,2-benzo-6-dibutylaminofluoran,
1,2-benzo-6-(N-methyl-N-cyclohexylamino)fluoran, and
1,2-benzo-6-(N-ethyl-N-toluidino)fluoran. These may be used alone or in combination.

The average particle diameter of the leuco dye is not particularly limited and may be suitably selected in accordance with the intended use. It is, however, preferably 0.05 μm to 0.7 μm, more preferably 0.1 μm to 0.5 μm, and particularly preferably 0.1 μm to 0.3 μm. By controlling the average particle diameter of the leuco dye from 0.05 μm to 0.7 μm, it is possible for the thermosensitive recording layer to improve the coloring properties. By adding a dispersant and/or a surfactant to the leuco dye as required, the leuco dye can be dispersed while the average particle diameter thereof maintained from 0.05 μm to 0.7 μm. The dispersant and/or the surfactant may be incorporated in an amount of 5% to 20% on a mass basis, into the leuco dye. As a dispersing machine for use the dispersion treatment, a ball mill, an atrighter, a sand mill, a high-pressure jet mill or the like can be used. As fine particle formation and dispersion, it is preferable to use a medium such as a ball. A zirconia medium having a diameter of 0.5 mm or smaller is used from the start, or a zirconia medium having a diameter of 0.5 mm to 1.0 mm is used to coarsely crush the leuco dye, and subsequently a zirconia medium having a diameter of 0.5 mm or smaller is used to disperse the leuco dye, thereby making it possible to form fine particles. Note that, the average particle diameter of the leuco dye is an average particle diameter measured by laser diffusion/scattering method (e.g., MICROTRACK HRA9320-X100 Model, LA920 Model manufactured by HORIBA Ltd., and LASENTEC FBRM).

<<Electron-Accepting Compound>>

The electron-accepting compound (developer) is not particularly limited, as long as it has an action of coloring the electron-donating color-forming compound (color former), and may be suitably selected in accordance with the intended use. Examples thereof include organic phosphoric acid compounds, fatty acid carboxylic acid compounds, phenol compounds, metal salts of mercapto acetic acid, and phosphate. These may be selected in combination with the electron-donating color-forming compound (color former), in consideration of the melting point and the color forming ability.

The electron-accepting compound (developer) is not particularly limited and may be suitably selected in accordance with the intended use. It is, however, preferably a compound represented by the following General Formula (1), in terms of the color forming density and the color erasing properties.

General Formula (1)

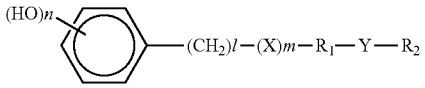

(where l is a natural number of 0 to 2; m is 0 or 1; n is an integer of 1 to 3; X and Y each represent a divalent group containing an N atom or an O atom; $R_1$ represents an aliphatic hydrocarbon group having 2 or more carbon atoms which may have a substituent; and $R_2$, represents an aliphatic hydrocarbon group having one or more carbon atoms.)

In General Formula (1), the aliphatic hydrocarbon group may be a straight chain or may be branched, and may have an unsaturated bond. Examples of the substituent of the aliphatic hydrocarbon group include a hydroxyl group, a halogen atom, and an alkoxy group. When the sum of carbon atoms of $R_1$ and $R_2$ is 7 or less, the color stability and color erasing ability may degrade. Therefore, the sum of carbon atoms of $R_1$ and $R_2$ is preferably 8 or more, and more preferably 11 or more.

As the aliphatic hydrocarbon group $R_1$, the following are exemplified.

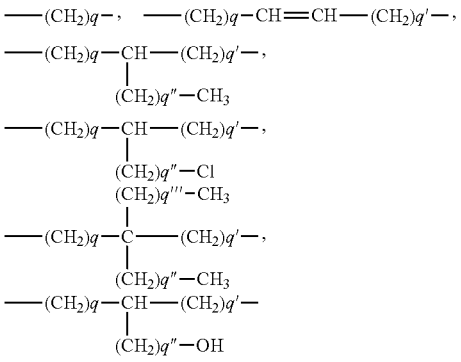

Where q, q', q" and q'" each represent an integer satisfying the carbon atoms of $R_1$ and $R_2$, and among these, —$(CH_2)$q- is preferable.

As the aliphatic hydrocarbon group $R_2$, the following are exemplified.

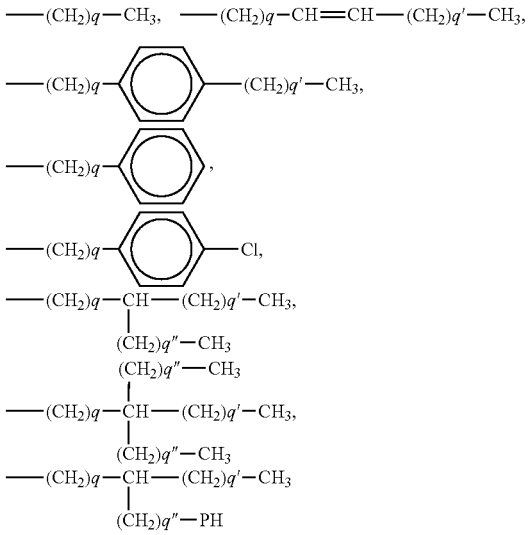

Where q, q' and q" each have the same meaning as described above. Among these, —$(CH_2)$q-$CH_3$ is preferable.

X and Y each represent a divalent group containing an N atom or an O atom, and preferably represent a divalent group having at least one group represented by the following general formula. Examples of such a divalent group include the following.

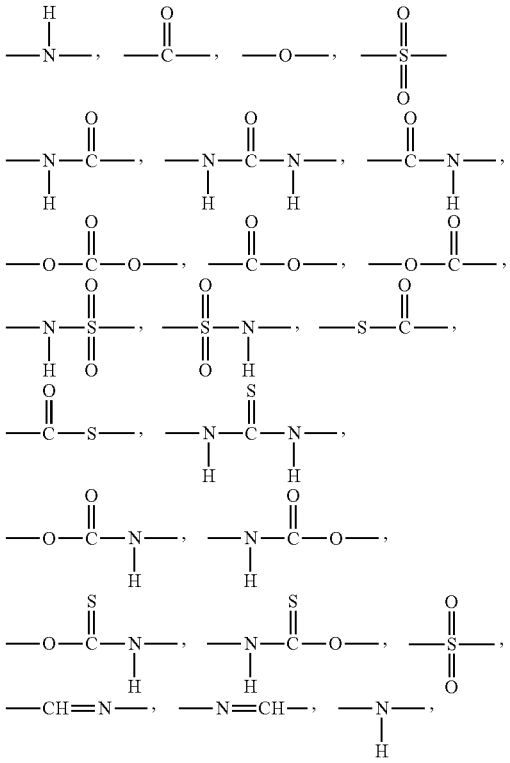

-continued
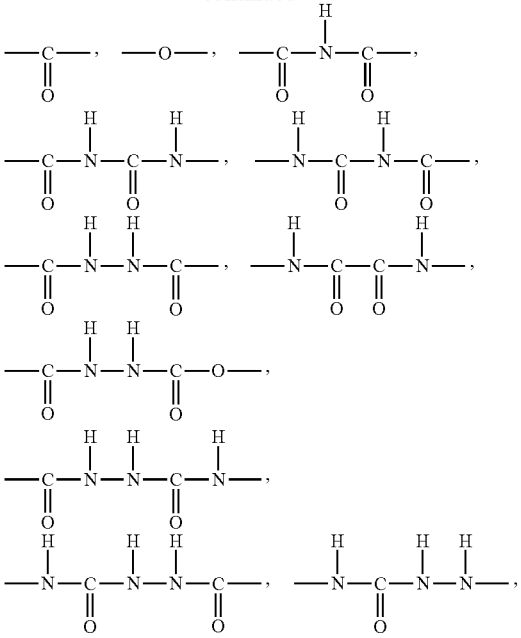
-continued
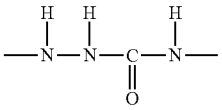
Among those described above, the following are preferable.
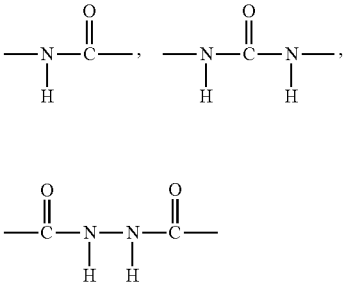
As the compound represented by General Formula (1), the following are exemplified.
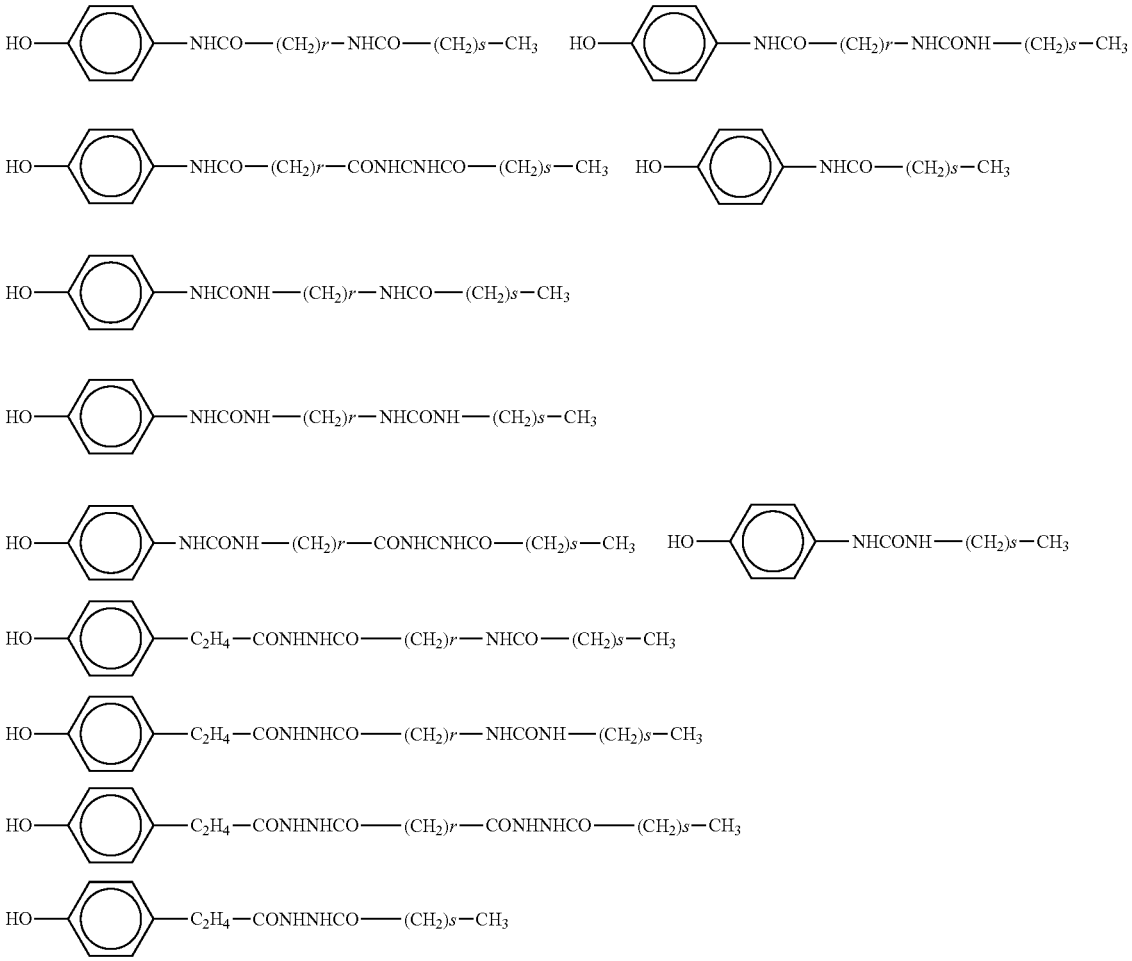

Where r is an integer of 2 or more, and s is an integer of 1 or more.

The average particle diameter of the electron-accepting compound (developer) is not particularly limited and may be suitably selected in accordance with the intended use. It is preferable 0.1 μm to 2.5 μm, and more preferably 0.5 μm to 2.0 μm. When the average particle diameter of the electron-accepting compound (developer) is within the range of 0.1 μm to 2.5 μm, the color forming properties can be improved if used as the electron-accepting compound (developer) for the thermoreversible recording medium. Further, when the average particle diameter is within the above range, it is advantageous in improving the color forming properties.

The mole ratio of the electron-donating color-forming compound (color former) to the electron-accepting compound (developer) is not particularly limited and may be suitably selected in accordance with the intended use. It is, however, preferably 1:0.1 to 1:20, and more preferably 1:0.2 to 1:10. When the amount of the electron-accepting compound (developer) is less than or more than the above range, the density of the coloring is reduced, which may leads to a problem. The electron-donating color-forming compound (color former) and the electron-accepting compound (developer) may be capsulated in a micro-capsule for use.

The mole ratio of the color-forming component to the resin in the thermoreversible recording layer is preferably 1:0.1 to 1:10. When the amount of the resin is less than the above range, the thermal strength of the thermoreversible recording layer is insufficient, and when the amount of the resin is more than the above range, the coloring density is reduced.

The electron-accepting compound (developer) can be dispersed while controlling the average particle diameter in the range of 0.05 μm to 0.7 μm by adding the dispersant and/or surfactant together with the leuco dye. The dispersant and/or surfactant may be incorporated in an amount of 5% to 20% on a mass basis, into the leuco dye. As a dispersing machine for use the dispersion treatment, a ball mill, an atrighter, a sand mill, a high-pressure jet mill or the like can be used. As fine particle formation and dispersion, it is preferable to use a medium such as a ball. A zirconia medium having a diameter of 0.5 mm or smaller is used, or a zirconia medium having a diameter of 0.5 mm to 1.0 mm is used to coarsely crush the electron-accepting compound (developer), and subsequently a zirconia medium having a diameter of 0.5 mm or smaller is used to disperse it, thereby making it possible to form fine particles.

Note that, the average particle diameter of the electron-accepting compound (developer) is an average particle diameter measured by laser diffusion/scattering method (e.g., MICROTRACK HRA9320-X100 Model, LA920 Model manufactured by HORIBA Ltd., and LASENTEC FBRM).

<<Reversible Thermosensitive Recording Composition>>

The reversible thermosensitive recording composition is not particularly limited, as long as it contains an electron-donating color-forming compound and an electron-accepting compound, and may be suitably selected in accordance with the intended use. For example, the composition is a composition in which an electron-donating color-forming compound and an electron-accepting compound are dispersed in a binder resin, and if necessary, additives for improving and controlling the coatability and the color-forming/color erasing properties of the thermosensitive recording layer may be added. Examples of the additives include controlling agents, surfactants, conducting agents, fillers, antioxidants, light stabilizers, and color-forming stabilizers.

—Binder Resin—

The binder resin has a function of keeping the reversible thermosensitive composition uniformly dispersed with stability even when the materials contained in the reversible thermosensitive composition are subjected to heating for recording and erasing.

The binder resin is not particularly limited and may be suitably selected in accordance with the intended use. Examples thereof include polyvinyl chloride, polyvinyl acetate, vinyl chloride-vinyl acetate copolymers, ethyl cellulose, polystyrene, styrene-based copolymers, phenoxy resins, polyester, aromatic polyester, polyurethane, polycarbonate, polyacrylic esters, polymethacrylic esters, acrylic acid-based copolymers, maleic acid-based copolymers, polyvinyl alcohols, modified polyvinyl alcohols, hydroxyethylcellulose, carboxymethylcellulose, and starches. Among these, binder resins having high thermal resistance, for example, binder resins which are crosslinked by heat, ultraviolet ray, an electron beam, a crosslinking agent, or the like are preferable.

The binder resin before crosslinked is not particularly limited and may be suitably selected in accordance with the intended use. Examples thereof include resins having a group reactive to a crosslinking agent (e.g., acryl polyol resins, polyester polyol resins, polyurethane polyol resins, phenoxy resins, polyvinyl butyral resins, cellulose acetate propionate, and cellulose acetate butyrate); and resins obtained by copolymerization of a monomer having a group reactive to a crosslinking agent, with a monomer other than the above monomer. Note that the binder resin is not limited to crosslinked resins obtained by using these resins before crosslinked in combination with a crosslinking agent.

The aryl polyol resin is not particularly limited and may be suitably selected in accordance with the intended use. Examples thereof include, as hydroxyl group-containing monomers, acryl polyol resins using hydroxyethyl acrylate (HEA), hydroxypropyl acrylate (HPA), 2-hydroxyethyl methacrylate (HEMA), 2-hydroxypropyl methacrylate (HPMA), 2-hydroxybutylacrylate (2-HBA), or 1-hydroxybutylacrylate (1-HBA). Among these hydroxyl-group containing monomers, 2-hydroxyethyl methacrylate, which has a primary hydroxyl group, is preferable in terms of the cracking resistance and durability of the coated film.

The crosslinking agent is not particularly limited and may be suitably selected in accordance with the intended use. Examples thereof include isocyanates, amines, phenols, and epoxy compounds. Among these, isocyanates (isocyanate-based compounds) are preferable.

The isocyanate-based compound is not particularly limited and may be suitably selected in accordance with the intended use. Examples thereof include a urethane-modified products of known isocyanate monomer, allophanate-modified products, isocyanurate-modified products, burette-modified products, carbodiimide-modified products, and modified products such as blocked isocyanates. The isocyanate monomer forming the above modified product is not particularly limited and may be suitably selected in accordance with the intended use. Examples thereof include tolylenediisocyanate (TDI), 4,4'-diphenylmethane diisocyanate (MDI), xylylene diisocyanate (XDI), naphthylene diisocyanate (NM), paraphenylene diisocyanate (PPM), tetramethyl xylylene diisocyanate (TMXDI), hexamethylene diisocyanate (HDI), dicyclohexylmethane diisocyanate (HMDI), isophoronediisocyanate (IPDI), lysinediisocyanate (LDI), isopropylidenebis(4-cyclohexylisocyanate) (IPC), cyclohexyldiisocyanate (CHDI), and tolidinediisocyanate (TODI).

A crosslinking accelerator (crosslinking agent) may also be added to the reversible thermosensitive composition. The crosslinking accelerator is not particularly limited and may be suitably selected in accordance with the intended use. Examples thereof include tertiary amines (e.g., 1,4-diazabicyclo[2,2,2]octane); and metal compounds (e.g., organic tin compounds). The total amount of the crosslinking agent to be added to the reversible thermosensitive composition may be or may not be crosslinking-reacted. This type crosslinking reaction proceeds with time, and thus the presence of unreacted crosslinking agent does not mean that the crosslinking reaction does not proceed at all, and even when unreacted crosslinking agent is detected, it does not mean that resin in a crosslinked state does not exist in the reversible thermosensitive composition. Further, as a method of differentiating whether the polymer used in the present invention is in a crosslinked state or in a non-crosslinked state, the coated film is dipped in a solvent having high solubility. That is, since a polymer in a non-crosslinked state is fused into a solvent and does not remain in a solute, it can be determined by checking the presence or absence of the polymer in the solute. If the presence or the polymer cannot be confirmed in the solute, it can be said that the polymer is in a non-crosslinked state, and can be determined as a non-crosslinked polymer. Here, this can be represented by a gel fraction.

The term "gel fraction" means a percentage of gel formed when a resin solute loses its independent mobility in a solvent due to the interaction, and is agglomerated and solidified. The gel fraction of the binder resin is not particularly limited and may be suitably selected in accordance with the intended use. For example, the gel fraction is preferably 30% or more, more preferably 50% or more, still more preferably 70% or more, and yet more preferably 80% or more. When the gel fraction is less than 30%, the repetitive durability may degrade. For increasing the gel fraction, a curable resin which is hardened by heat, UV, EB, or the like may be mixed with the binder resin, or the resin itself may be crosslinked.

The measurement method of the gel fraction is not particularly limited and may be suitably selected in accordance with the intended use. For example, a method is exemplified in which the film is separated from the support, the starting weight of the film is measured, the film is then sandwiched in a 400-wire mesh, and subsequently dipped in a solvent, in which the non-crosslinked resin is soluble, for 24 hours, dried in a vacuum, and then the weight of the dried film is measured.

The gel fraction is calculated based on the following equation.

Gel Fraction(%)[Weight of dried film (g)/Weight of starting weight (g)]×100

When the gel fraction is calculated based on the above equation, the weight of organic low-molecular weight materials and particles other than resin components in the reversible thermosensitive layer is excluded. At this time, when the weight of the organic low-molecular weight materials is unknown beforehand, the area ratio (per unit area) of the organic low-molecular weight materials is determined by observing a cross-section thereof by a TEM, an SEM or the like, and a weight ratio between the resin and the organic low-molecular weight materials is determined from their specific gravities to calculate the weight of the organic low-molecular weight materials and then a gel fraction value can be calculated.

At the time of measuring the gel fraction, when a thermoreversible recording layer is provided on a support and other layers such as a protective layer are laminated over the thermoreversible recording layer, or when other layers are formed between a support and a thermosensitive layer, first, the thermoreversible recording layer and the other layers are measured for their thicknesses by observing cross-sections thereof by a TEM, an SEM or the like, as described above, a surface of the laminate is scraped off by the thickness of the other layers other than the thermoreversible recording layer to make the surface of the thermoreversible recording layer exposed and peeled off from the laminate, and then the gel fraction thereof can be measured in the same manner as described above.

In this method, when an ultraviolet curable resin etc. is provided over the thermoreversible recording layer, in order to prevent these layers from mixed into the thermoreversible recording layer as much as possible, it is necessary to prevent the influence on the calculation of the gel fraction by scraping the laminate off by the thickness of these layers and scraping small amount of the thermoreversible recording layer off.

—Controlling Agent—

The controlling agent (decoloring accelerator) is not particularly limited and may be suitably selected in accordance with the intended use. It is, however, preferably a compound containing as a partial structure such as an amide group, urethane group, urea group, ketone group and diacylhydrazide, from the viewpoint of the coloring density and color erasing properties. Among these, compounds containing an amide group, a secondary amide group and a urethane group are more preferable. As specific examples of the compounds, the following are exemplified.

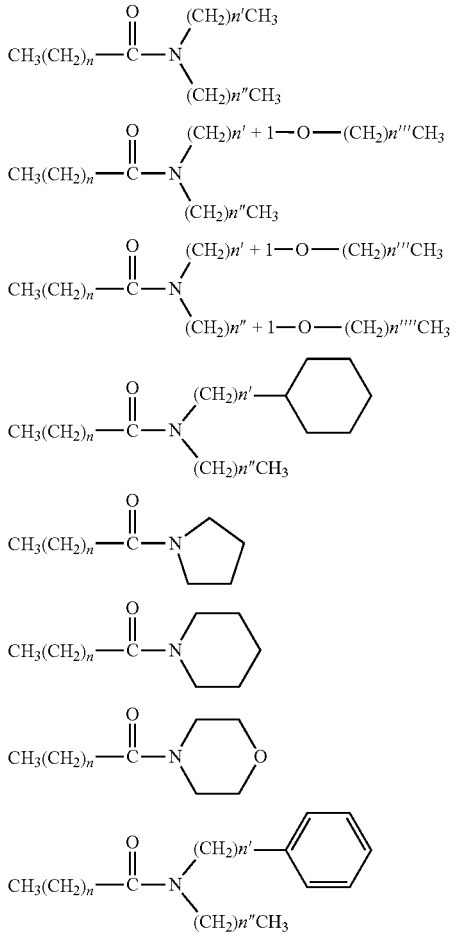

-continued

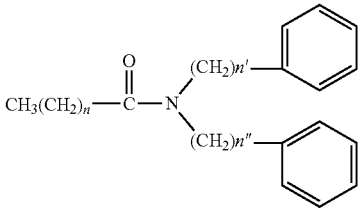

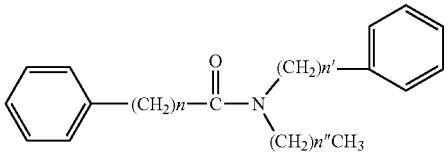

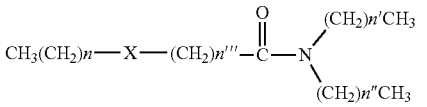

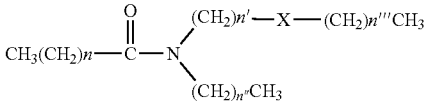

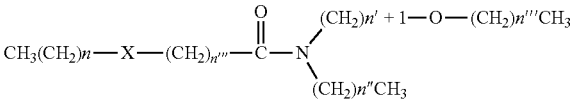

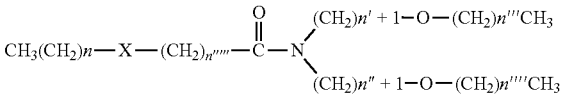

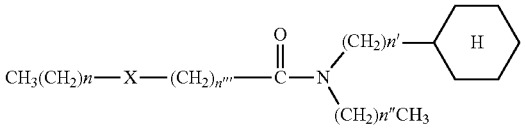

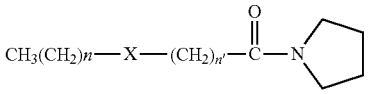

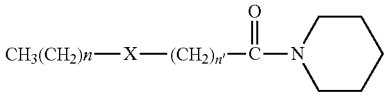

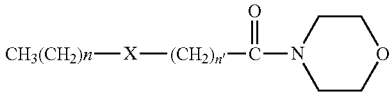

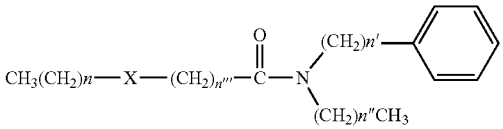

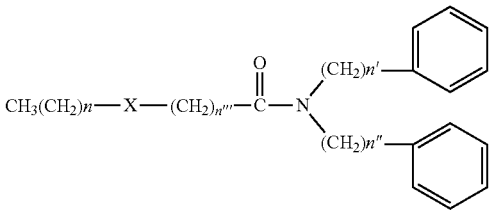

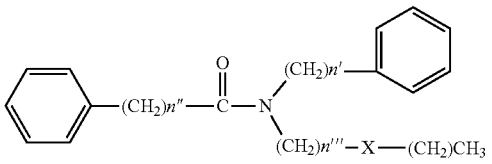

(where n, n', n'', n''', n'''' each represent an integer of 0 to 21, provided that not all of them are 5 or less.)

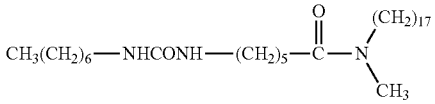

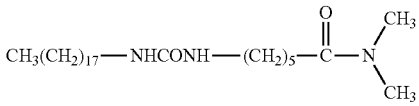

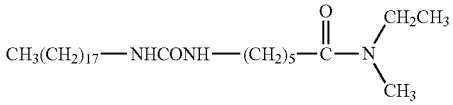

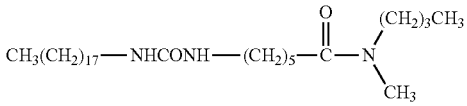

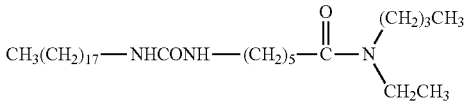

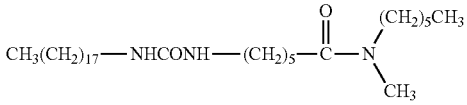

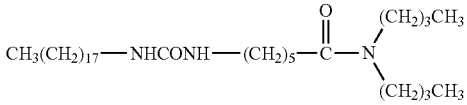

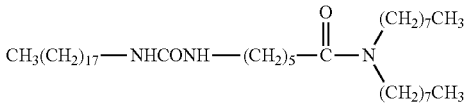

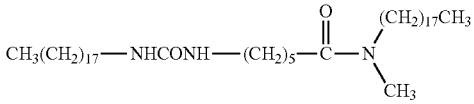

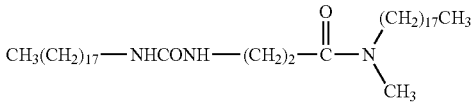

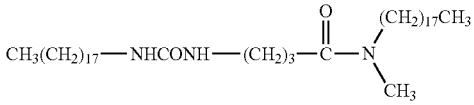

$C_{11}H_{23}CONHC_{12}H_{25}$, $C_{15}H_{31}CONHC_{16}H_{33}$, $C_{17}H_{35}CONHC_{18}H_{37}$, $C_{17}H_{35}CONHC_{18}H_{35}$, $C_{21}H_{41}CONHC_{18}H_{37}$, $C_{15}H_{31}CONHC_{18}H_{37}$, $C_{17}H_{35}CONHCH_2HNOCC_{17}H_{35}$, $C_{11}H_{23}CONHCH_2HNOCC_{11}H_{23}$, C7H15CONHC$_2$H$_4$HNOCC$_{17}$H$_{35}$, $C_9H_{19}CONHC_2H_4HNOCC_9H_{19}$, $C_{11}H_{23}CONHC_2H_4HNOCC_{11}H_{23}$, $C_{17}H_{35}CONHC_2H_4HNO$ $CC_{17}H_{35}$, $(CH_3)_2$ $CHC_{14}H_{35}CONHC_2H_4HNOCC_{14}H_{35}(CH_3)_2$, $C_{21}H_{43}CONHC_2H_4HNOCC_{21}H_{43}$, $C_{17}H_{35}CONHC_6H_{12}HNOCC_{17}H_{35}$, $C_{21}H_{43}CONHC_6H_{12}HNOCC_{21}H_{43}$, $C_{17}H_{33}CONHCH_2HNOCC_{17}H_{33}$, $C_{17}H_{33}CONHC_2H_4HNOCC_{17}H_{33}$, $C_{21}H_{41}CONHC_2H_4HNOCC_{21}H_{41}$, $C_{17}H_{33}CONHC_6H_{12}HNOCC_{17}H_{33}$, $C_8H_{17}NHCOC_2H_4CONHC_{18}H_{37}$, $C_{10}H_{21}NHCOC_2H_4CONHC_{10}H_{21}$,
$C_{12}H_{25}NHCOC_2H_4CONHC_{12}H_{25}$,
$C_{18}H_{37}NHCOC_2H_4CONHC_{18}H_{37}$,
$C_{21}H_{43}NHOCC_2H_4CONHC_{21}H_{43}$,
$C_{18}H_{37}NHOCC_6H_{12}CONHC_{18}H_{37}$,
$C_{18}H_{35}NHCOC_4H_8CONHC_{18}H_{35}$,
$C_{18}H_{35}NHCOC_8H_{16}CONHC_{18}H_{35}$,
$C_{12}H_{25}OCONHC_{18}H_{37}$, $C_{13}H_{27}OCONHC_{18}H_{37}$,
$C_{16}H_{33}OCONHC_{18}H_{37}$, $C_{18}H_{37}OCONHC_{18}H_{37}$,
$C_{21}H_{43}OCONHC_{18}H_{37}$, $C_{12}H_{25}OCONHC_{16}H_{33}$,
$C_{13}H_{27}OCONHC_{16}H_{33}$, $C_{16}H_{33}OCONHC_{16}H_{33}$,
$C_{18}H_{37}OCONHC_{16}H_{33}$, $C_{21}H_{43}OCONHC_{16}H_{33}$,
$C_{12}H_{25}OCONHC_{14}H_{29}$, $C_{13}H_{27}OCONHC_{14}H_{29}$,
$C_{16}H_{33}OCONHC_{14}H_{29}$, $C_{18}H_{37}OCONHC_{14}H_{29}$,
$C_{22}H_{45}OCONHC_{14}H_{29}$, $C_{12}H_{25}OCONHC_{12}H_{37}$,
$C_{13}H_{27}OCONHC_{12}H_{37}$, $C_{16}H_{33}OCONHC_{12}H_{37}$,
$C_{18}H_{37}OCONHC_{12}H_{37}$, $C_{21}H_{43}OCONHC_{12}H_{37}$,
$C_{22}H_{45}OCONHC_{18}H_{37}$,
$C_{18}H_{37}NHCOOC_2H_4OCONHC_{18}H_{37}$,
$C_{18}H_{37}NHCOOC_3H_6OCONHC_{18}H_{37}$,
$C_{18}H_{37}NHCOOC_4H_8OCONHC_{18}H_{37}$,
$C_{18}H_{37}NHCOOC_6H_{12}OCONHC_{18}H_{37}$,
$C_{18}H_{37}NHCOOC_8H_{16}OCONHC_{18}H_{37}$,
$C_{18}H_{37}NHCOOC_2H_4OC_2H_4OCONHC_{18}H_{37}$,
$C_{18}H_{37}NHCOOC_3H_6OC_3H_6OCONHC_{18}H_{37}$,
$C_{18}H_{37}NHCOOC_{12}H_{24}OCONHC_{18}H_{37}$,
$C_{18}H_{37}NHCOOC_2H_4OC_2H_4OC_2H_4OCONHC_{18}H_{37}$,
$C_{16}H_{33}NHCOOC_2H_4OCONHC_{16}H_{33}$,
$C_{16}H_{33}NHCOOC_3H_6OCONHC_{16}H_{33}$,
$C_{16}H_{33}NHCOOC_4H_8OCONHC_{16}H_{33}$,
$C_{16}H_{33}NHCOOC_6H_{12}OCONHC_{16}H_{33}$,
$C_{16}H_{33}NHCOOC_8H_{16}OCONHC_{16}H_{33}$,
$C_{18}H_{37}OCOHNC_6H_{12}NHCOOC_{18}H_{37}$,
$C_{16}H_{33}OCOHNC_6H_{12}NHCOOC_{16}H_{33}$,
$C_{14}H_{29}OCOHNC_6H_{12}NHCOOC_{14}H_{29}$,
$C_{12}H_{25}OCOHNC_6H_{12}NHCOOC_{12}H_{25}$,
$C_{10}H_{21}OCOHNC_6H_{12}NHCOOC_{10}H_{21}$,
$C_8H_{17}OCOHNC_6H_{12}NHCOOC_8H_{17}$

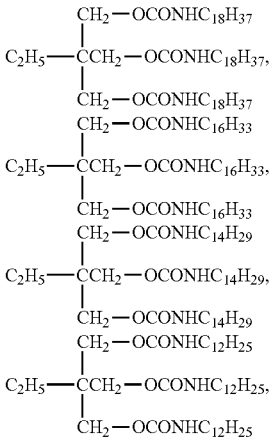

-continued

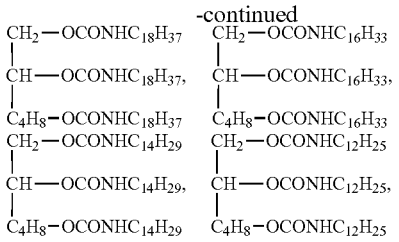

These compounds may be used alone or in combination.

The amount of the controlling agent (decoloring accelerator) contained in the electron-accepting compound (developer) is not particularly limited and may be suitably selected in accordance with the intended use. It is, however, preferably 0.1% by mass to 300% by mass, and more preferably 3% by mass to 100% by mass. The controlling agent may be uniformly mixed when the electron-donating color-forming compound (color former) and the electron-accepting compound (developer) are mixed with each other.

The thermosensitive recording layer in the thermoreversible recording medium according to the present invention is composed of a composition where the electron-donating color-forming compound (color former) and the electron-accepting compound (developer) are finely, uniformly dispersed in the binder resin. The electron-donating color-forming compound (color former) and the electron-accepting compound (developer) may individually form particles, however, more preferably, composite particles formed from these compounds are dispersed in the binder resin. This state can be achieved by menting and dissolving the electron-donating color-forming compound (color former) and the electron-accepting compound (developer). Such a reversible thermosensitive composition can be applied onto a support in the form of a mixture liquid in which these materials are individually dispersed or dissolved in a solvent and then the obtained liquids are mixed with each other, or in the form of a mixture liquid in which these materials are mixed and dispersed or dissolved in a solvent. The electron-donating color-forming compound (color former) and the electron-accepting compound (developer) may also be capsulated in a micro-capsule for use.

The reversible thermosensitive composition is a coating liquid which is prepared by uniformly mixing and dispersing a mixture containing the electron-donating color-forming compound (color former), the electron-accepting compound (developer), various additives, a curing agent, a resin in a crosslinked state, a solvent for coating liquid and the like.

The solvent for use in the preparation of the coating liquid is not particularly limited and may be suitably selected in accordance with the intended use. Examples thereof include water; alcohols (e.g., methanol, ethanol, isopropanol, n-butanol, and methylisocarbinol); ketones (e.g., acetone, 2-butanone, ethylamylketone, diacetone alcohol, and isophorone, cyclohexanone); amides (e.g., N,N-dimethylformamide, and N,N-dimethylacetamide); ethers (e.g., diethylether, isopropylether, tetrahydrofuran, 1,4-dioxane, 3,4-dihydro-2H-pyran); glycol ethers (e.g., 2-methoxyethanol, 2-ethoxyethanol, 2-buthoxyethanol, and ethylene glycol dimethylether); glycol ether acetates (e.g., 2-methoxyethyl acetate, 2-ethoxyethyl acetate, and 2-butoxyethyl acetate); esters (e.g., methyl acetate, ethyl acetate, isobutyl acetate, amyl acetate, ethyl lactate, and ethylene carbonate); aromatic hydrocarbons (e.g., benzene, toluene, and xylene); aliphatic hydrocarbons (e.g., hexane, heptane, iso-octane, and cyclohexane); halogenated hydrocarbons (e.g., methylene chloride, 1,2-dichloroethane, dichloropropane, and chlorobenzene); sulfoxides (e.g., dimethylsulfoxide); and pyrrolidones (e.g., N-methyl-2-pyrrolidone, and N-octyl-2-pyrrolidone).

The coating liquid can be prepared using a known dispersing machine for coating liquid, such as a paint shaker, a ball mill, an atrighter, a triple-roll mill, a keddy mill, a sand mill, DYNO mill, and a colloid mill. these materials may be dispersed in a solvent using the dispersing machine, or may be individually dispersed in a solvent and dispersed so as to be mixed. Further, these materials may be dissolved under application of heat and then rapidly cooled or slowly cooled to be precipitated.

<<Formation of Reversible Thermosensitive Recording Layer>>

In order to form the reversible thermosensitive recording layer on a support, a conventionally known method may be employed. For example, the coating liquid for a reversible thermosensitive composition may be applied onto the support and then dried. The coating method of the reversible thermosensitive composition is not particularly limited and may be suitably selected in accordance with the intended use. Examples thereof include blade coating, wire-bar coating, spray coating, air-knife coating, bead coating, curtain coating, gravure coating, kiss coating, reverse roll coating, dip coating, and die coating.

After applying the reversible thermosensitive composition, the composition is dried and if necessary subjected to curing (hardening) treatment so that the binder resin is completely crosslinked. The drying and hardening treatment may be performed at a relatively high temperature for a short time, using a thermostatic bath etc., or may be heated at a relatively low temperature for a long time. The conditions for the hardening reaction are not particularly limited and may be suitably selected in accordance with the intended use. From the viewpoint of reactivity, the composition is preferably warmed at a temperature of about 30° C. to about 130° C. for about 1 minute to about 150 hours, and more preferably warmed at a temperature of 40° C. to 100° C. for about 2 minutes to about 120 hours. In addition, a crosslinking step may be provided separately from a drying step. The conditions for the crosslinking step are not particularly limited and may be suitably selected in accordance with the intended use. However, preferably the composition is warmed at a temperature of 40° C. to 100° C. for about 2 minutes to about 120 hours.

The thickness of the reversible thermosensitive recording layer varies depending on the type of the electron-donating color-forming compound (color former) and the electron-accepting compound (developer), and it is not particularly limited and may be suitably selected in accordance with the intended use. The thickness is, however, preferably from 1 μm to 20 μm, and more preferably from 3 μm to 15 μm. When the thickness of the reversible thermosensitive recording layer is less than 1 μm, the contrast when a color is formed may be imperfect. When the thickness is more than, 20 μm, the thermal sensitivity of the reversible thermosensitive recording layer may degrade.

<Metal Compound-Containing Layer (Gas Barrier Layer)>

The metal compound-containing layer (gas barrier layer) contains at least a resin, a metal compound, and an inorganic layer compound, and further contains other components as required.

The metal compound-containing layer (gas barrier layer) has a function to prevent the thermoreversible recording layer from color-fading and being discolored due to a reaction between the electron-donating color-forming compound (color former) and the electron-accepting compound (developer) and inclusion of oxygen into the thermoreversible recording layer, by covering the thermoreversible recording layer. Particularly, with increasing usage period of the thermoreversible recording medium, it is necessary to further improve the gas barrier properties of the metal compound-containing layer (gas barrier layer). By preventing oxygen from entering into the reversible thermosensitive recording layer, the thermoreversible recording medium can be made excellent in light resistance, and the color fading and discoloration thereof can be prevented for a long period of time.

The thickness of the metal compound-containing layer (gas barrier layer) varies depending on the oxygen permeability of the metal compound-containing layer (gas barrier layer), and is not particularly limited and may be suitably selected in accordance with the intended use. The thickness is, however, preferably from 0.1 μm to 10 μm, and more preferably from 0.3 μm to 5 μm. When the thickness of the metal compound-containing layer (gas barrier layer) is less than 0.1 μm, the oxygen barrier properties and water barrier properties thereof may be imperfect. When it is more than 10 μm, the sensitivity of the reversible thermosensitive recording layer to a heating head may degrade.

The metal compound-containing layer (gas barrier layer) may be a single layer and may be a multi-layer composed of a plurality of layers. When the metal compound-containing layer (gas barrier layer) is a multi-layer, it is advantageous in gas barrier reliability.

<<Resin>>

The resin is not particularly limited, as long as it contains at least one selected from the group consisting of polyvinyl alcohol polymers and ethylene-vinyl alcohol copolymers, and may be suitably selected in accordance with the intended use (the application, the oxygen permeability, the transparency, properties of mixing with the inorganic layer compound, the adhesion thereof relative to the thermosensitive recording layer, the humidity resistance, and the ease of coating). However, a resin having a high transmissivity to visible light is preferable.

The resin may be a polyvinyl alcohol polymer having gas barrier properties, and may be an ethylene-vinyl alcohol copolymer having humidity resistance in addition to the gas barrier properties or may be composition of a gas barrier-resin containing these components.

The polyvinyl alcohol polymer is not particularly limited and may be suitably selected in accordance with the intended use. Examples thereof include polyvinyl alcohol, derivatives of polyvinyl alcohol, and modified products of polyvinyl alcohol. These may be used alone or in combination.

The derivatives of polyvinyl alcohol are not particularly limited and may be suitably selected in accordance with the intended use. Examples thereof include a polyvinyl derivative which is acetalized to about 40 mol % of the hydroxyl group.

The modified product of polyvinyl alcohol is not particularly limited and may be suitably selected in accordance with the intended use. Examples thereof include a polyvinyl alcohol-modified product obtained by copolymerization of a carboxyl group-containing monomer, an amino group-containing monomer, or the like.

The polymerization degree of the polyvinyl alcohol polymer is not particularly limited and may be suitably selected in accordance with the intended use. It is, however, preferably 100 to 5,000, and more preferably 500 to 3,000.

The saponification degree of the polyvinyl alcohol polymer is not particularly limited and may be suitably selected in accordance with the intended use. It is, however, preferably 60 mol % or more, and more preferably 75 mol % or more.

Note that the polyvinyl alcohol polymer has an advantage in that it has very high gas barrier properties in a dried state, but the decreasing degree of the gas barrier properties thereof under a high humidity condition is greater than those of an ethylene-vinyl alcohol copolymer. Thus, when the polyvinyl alcohol polymer is used under a high humidity condition, it is preferable to increase the amount of the after-mentioned inorganic layer compound at the time of forming the metal compound-containing layer (gas barrier layer).

The ethylene-vinyl alcohol copolymer is not particularly limited and may be suitably selected in accordance with the intended use. It is, however, preferably a resin obtainable by saponification of an ethylene-vinyl acetate copolymer.

The resin obtainable by saponification of an ethylene-vinyl acetate copolymer is not particularly limited and may be suitably selected in accordance with the intended use. Examples thereof include a resin obtainable by saponification of an ethylene-vinyl acetate copolymer which can be obtained by copolymerization of ethylene and vinyl acetate; and a resin obtainable by saponification of an ethylene-vinyl acetate copolymer which can be obtained by copolymerization of ethylene, vinyl acetate, and other monomers.

The ethylene ratio in the monomer before copolymerization of the ethylene-vinyl acetate copolymer is not particularly limited and may be suitably selected in accordance with the intended use. It is, however, preferably 20 mol % to 60 mol %. When the ethylene ratio is less than 20 mol %, the gas barrier properties thereof under high humidity conditions may degrade. In contrast, when the ethylene ratio is more than 60 mol %, the gas barrier properties tend to degrade.

The ethylene-vinyl alcohol copolymer is not particularly limited and may be suitably selected in accordance with the intended use. It is, however, preferably a resin having a saponification degree of vinyl acetate components of 95 mol % or more.

When the saponification degree of the vinyl acetate components is less than 95 mol %, the gas barrier properties and oil resistance may be insufficient. As the ethylene-vinyl alcohol copolymer, a resin which is treated with a peroxide or the like so as to have a low-molecular weight is preferable, in terms of improving the dissolution stability in a solvent.

Water-soluble resins including the ethylene-vinyl alcohol copolymer are poor in water resistance due to their water solubility if used singularly. Therefore, in the present invention, an organic metal compound containing at least one of an organic titanium compound and an organic zirconium compound is used as a curing agent (hardener) of the water-soluble resin. The organic metal compound has high reactivity with water-soluble resins, and thus, a coating layer excellent in water resistance can be formed in the present invention. In the present invention, the organic titanium compound and the organic zirconium compound are each a compound having, in the molecule, at least one structure in which an organic group is directly or via other bond (e.g., oxygen atom, nitrogen atom), bonded to titanium or zirconium.

Examples of the organic zirconium compound include zirconium chelate [General Formula: $Zr(OR)_n(X)_{4-n}$, R=an organic group, X=a ligand, n=an integer of 0 to 3], zirconium acylate [General Formula: $Zr(OR^1)_n(OCOR^2)_{4-n}$, $R^1$,$R^2$=an organic group, n=an integer of 0 to 3], and zirconium alkoxide [General Formula: $Zr(OR)_4$, R=an organic group]. Examples of the zirconium chelate include zirconium tetraacetylacetonate, zirconium tributoxy acetylacetonate, zirconium monobutoxy acetylacetonate-bis-ethylacetoacetate, zirconium dibutoxy-bis-ethylacetoacetate, and zirconium tetraacetylacetonate. Examples of the zirconium acylate include zirconium acetate, zirconium tributoxy stearate. Examples of the zirconium alkoxide include tetranormalpropoxy zirconium, and tetranormalbutoxy zirconium.

Examples of the organic titanium compound include titanium chelate [General Formula: $Ti(OR)_n(X)_{4-n}$, R=an organic group, X=a ligand, n=an integer of 0 to 3], titanium acylate [General Formula: $Ti(OR^1)_n(OCOR^2)_{4-n}$, $R^1$,$R^2$=an organic group, n=an integer of 0 to 3], titanium alkoxide [General Formula: $Ti(OR)_4$, R=an organic group]. Examples of the titanium chelate include titanium acetyl acetate, triethanolamine titanate, titanium ammonium lactate, titanium lactate, and titanium diisopropoxy bis(triethanolaminate). Examples of the titanium acylate include polyhydroxy titanium stearate, and polyisopropoxytitanium stearate. Examples of the titanium alkoxide include tetraisopropyl titanate, tetra-n-butyl titanate, tetra-2-ethylhexyl titanate, and tetrastearyl titanate.

The organic metal compound is not particularly limited and may be suitably selected in accordance with the intended use. However, chelate compounds and acrylate compounds are preferable in terms of the water resistance and adhesion properties.

The amount of metal contained in the metal compound-containing layer is not particularly limited and may be suitably selected in accordance with the intended use. It is, however, preferably 0.1% by mass to 15% by mass more preferably 0.2% by mass to 10% by mass, and particularly preferably 2% by mass to 8% by mass.

When the metal content of the metal compound-containing layer is less than 0.1% by mass, the adhesion may be insufficient, and when it is more than 15% by mass, the oxygen barrier properties may degrade. When the metal content of the metal compound-containing layer is within the above preferable range, it is advantageous in terms of achieving both the adhesion and the oxygen barrier properties.

By adding the organic metal compound, the agglomeration fracture of the metal compound-containing layer can be prevented, thereby making it possible to prevent the occurrence of pin holes.

<<Inorganic Layer Compound>>

The inorganic layer compound may be a natural product or a synthetic product of a swellable clay mineral, is not particularly limited, as long as it has humidity resistance, and may be suitably selected in accordance with the intended use. An inorganic layer compound which is swollen and cleaved in a dispersion medium is preferable. The inorganic layer compound which is swollen and cleaved in a dispersion medium is not particularly limited and may be suitably selected in accordance with the intended use. Examples thereof include kaolinites having 1:1 structure of phyllosilicate; anchorites belonging to Jammon group, smectites, vermiculites which are hydrosilicate minerals, and micas depending on the number of interlayer cations. Specific examples of the inorganic layer compound which is swollen and cleaved in a dispersion medium include kaolinite, nacrite, dickite, halloysite, water-added halloysite, antigorite, chrysotile, pyrophyllite, montmorillonite, bidelite, saponite, hectorite, sauconite, stevensite, tetrasilylic mica, sodium taeniolite, white mica, margarite, talc, vermiculite, gold mica, xanthophyllite, chlorite, scale-like silica. These may be used alone or in combination. Among these, montmorillonite, and mica are preferable from the viewpoint that when used as a gas barrier layer.

When the inorganic layer compound is a natural product, the size thereof after dispersed in the resin is relatively large, and thus it is advantageous in easily ensuring the gas barrier function, but inorganic metal ions contained in a small amount as impurities may cause oxidation degradation of the metal compound-containing layer (gas barrier layer) and other layers by application of thermal energy in image formation on a recording medium to form colored components.

This phenomenon is visually recognized as unerased residues when an original image formed on the thermoreversible recording medium is erased, and significantly impairs the image quality. To prevent degradation of the image quality, it is preferable to prevent oxidation degradation that could be caused by impurities of inorganic metal ions by adding alkali metal or alkali earth metal when the inorganic layer compound as a natural product is mixed with the resin.

When the inorganic layer compound is a synthetic product of swellable clay mineral, almost no impurities described above are present, and thus it does not cause degradation of the image quality. However, in the synthesis treatment of the inorganic layer compound, the particle diameters thereof become smaller and gas passing path length becomes shorter, and desired gas barrier properties may not be exhibited. As the inorganic layer compound, any of inorganic layer compounds of natural products and synthetic products can be used, and the gas barrier properties can be improved by selecting the mixing ratio of the resin/inorganic layer compound while properly grasping the physical properties of materials to be used.

The synthetic product is not particularly limited and may be suitably selected in accordance with the intended use. Examples thereof include synthetic micas, and micas obtained by physically or chemically treating natural micas.

The shape of the inorganic layer compound is not particularly limited and may be suitably selected in accordance with the intended use. For example, the inorganic layer compound is preferably formed in a plate shape having a length and a width of from 5 nm to 5,000 nm, more preferably from 10 nm to 3,000 nm, and preferably having a thickness of about 1/10 to about 1/10,000 the length thereof, more preferably having about 1/50 to about 1/5,000 the length thereof.

When one of the length and the width of the inorganic layer compound exceeds 5,000 nm, mixture nonuniformity easily occurs in the metal compound-containing layer (gas barrier layer), and it may be difficult to uniformly mix the composition and to form a thin film. When one of the length and the width of the inorganic layer compound is less than 5 nm, the inorganic layer compound is arranged in parallel with the metal compound-containing layer (gas barrier layer) in the metal compound-containing layer (gas barrier layer), hardly dispersed therein, and the gas barrier properties may degrade. When the thickness of the inorganic layer compound exceeds 1/10 the length thereof, the inorganic layer compound is arranged in parallel with the metal compound-containing layer (gas barrier layer) in the metal compound-containing layer (gas barrier layer), hardly dispersed therein, and the gas barrier properties may degrade.

The mass ratio of the resin to the inorganic layer compound in the metal compound-containing layer (gas barrier layer) is not particularly limited and may be suitably selected in accordance with the intended use. It is, however, preferably from 95/5 to 50/50, and more preferably from 90/10 to 65/35. When the mass ratio of the inorganic layer compound is less than 5, the effect thereof becomes insufficient because of a lack of gas barrier properties. When the mass ratio of the inorganic layer compound is more than 50, the coated film may be peeled off and the transparency thereof may be impaired because of insufficiency of the strength and the adhesion of the coated film with respect to other layers. Here, partial peel-off (partial separation) of the metal compound-containing layer (gas barrier layer) is liable to cause white turbidity of the thermoreversible recording medium.

Figure 5:
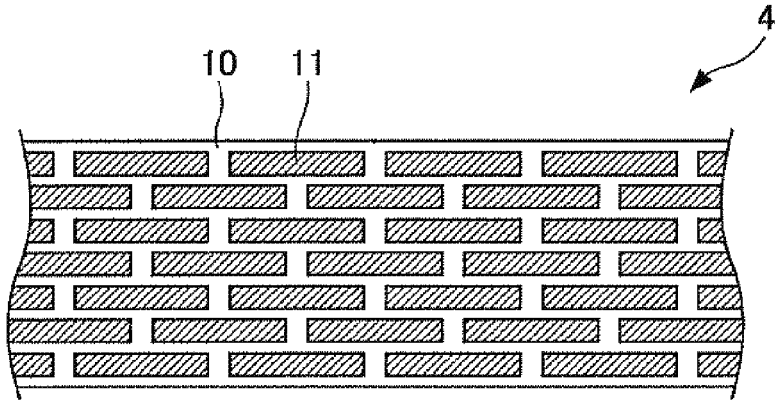
FIG. 5 is a cross-sectional view of a metal compound-containing layer in a thermoreversible recording medium according to the present invention.
Figure 6:
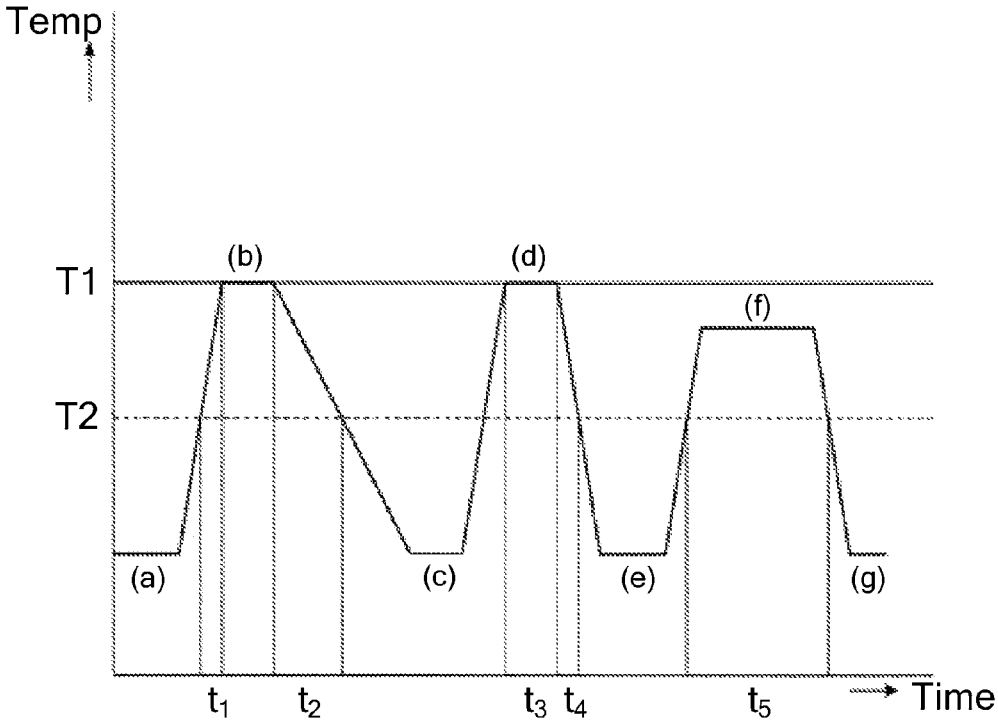
FIG. 6 is a view illustrating coloring/decoloring of a thermoreversible recording medium according to the present invention.

In the metal compound-containing layer (gas barrier layer), it is preferable that the inorganic layer compound be dispersed so as to be arranged in parallel along the layer direction of the metal compound-containing layer (gas barrier layer). FIG. 5 schematically illustrates a cross-section of a metal compound-containing layer (gas barrier layer) 4 in a thermoreversible recording medium of the present invention. When an inorganic layer compound 11 is dispersed in a dispersion liquid containing solvent and a gas barrier resin 10 and formed as a compound-containing layer (gas barrier layer) 4, it has a tendency to be arranged in parallel along the layer direction in the gas barrier 10 as illustrated in FIG. 5. When the inorganic layer compound 11 is arranged in a laminar form along the layer direction in the metal compound-containing layer (gas barrier layer) 4, and in the case where gas molecules such as oxygen and water vapor gas pass from the top to the bottom of the metal compound-containing layer (gas barrier layer) 4, the gas molecules pass the thermoreversible recording medium while bypassing the inorganic layer compound 11. In this case, the route that the gas molecules pass the metal compound-containing layer (gas barrier layer) 4 is significantly longer than the perpendicular distance (length) of the cross-section of the metal compound-containing layer (gas barrier layer) 4. The gas barrier resin 10 forming the metal compound-containing layer (gas barrier layer) 4 inherently has gas barrier properties, and thus when the gas permeation route is longer than the cross-section of the metal compound-containing layer (gas barrier layer) 4, the gas barrier properties are improved in proportion to the length of the gas permeation route.

As described above, by dispersing the inorganic layer compound 11 in the metal compound-containing layer (gas barrier layer) 4, in particular, in parallel along the layer direction of the metal compound-containing layer (gas barrier layer) 4, the water blocking properties of the metal compound-containing layer (gas barrier layer) 4 are improved in addition to the oxygen blocking properties. Especially, the gas barrier resin 10 made of polyvinyl alcohol, which is excellent in oxygen blocking properties, has water absorbability, although the oxygen blocking properties thereof under high humidity environments were found to be insufficient. By adding the inorganic layer compound 11 into the gas barrier resin 10, the metal compound-containing layer (gas barrier layer) 4 can exhibit excellent oxygen blocking properties even under high humidity environments. Further, it is possible to prevent the metal compound-containing layer (gas barrier layer) 4 from deteriorating due to water absorbance of the gas barrier resin 10 and also to prevent peel-off of the metal compound-containing layer (gas barrier layer) 4 from thermosensitive recording layer.

Since the inorganic layer compound is present in the gas barrier resin in a state of being oriented in the layer direction of the gas barrier layer, the gas barrier properties of the gas barrier layer can be improved.

<<Adhesion Improver>>

Since the metal compound-containing layer (gas barrier layer) contains the inorganic layer compound, an adhesion improver for improving the adhesion with the thermosensitive recording layer and adjacent layers such as the protective layer may be added thereinto. So as to be sustainable to a plural number of forming and erasing processes, which is a basic characteristic of the thermoreversible recording medium, that is, so as to sustainable to the repeated heating and cooling, at least one adhesion improvers for improving the adhesion to adjacent layers (e.g., silane coupling agents, titanium coupling agents, isocyanate compounds, aziridine compounds, and carbodiimide compounds) may be added to the gas barrier layer.

The silane coupling agent is not particularly limited and may be suitably selected in accordance with the intended use.

Examples thereof include alkoxy silanes having a vinyl group (e.g., vinyltrimethoxysilane, vinyltriethoxysilane, N-β-(N-vinylbenzylaminoethyl)-γ-aminopropyltrimethoxysilane, vinyltriacetoxysilane, and 3-methacrylpropyltrimethoxysilane; alkoxy silanes having an epoxy group (e.g., 3-glycidoxypropy trimethoxysilane, 3-glycidoxypropyl methyldimethoxysilane, and 2-(3,4-epoxycyclohexyl)ethyl trimethoxysilane); alkoxy silanes having an amino group and/or an imino group (e.g., 3-aminopropyl triethoxysilane, 3-N-(2-aminoethyl)aminopropyl trimethoxysilane, 3-N-(2-aminoethyl)aminopropyl methyldimethoxysilane); isocyanate alkoxy silanes (e.g., triethoxysilylpropyl isocyanate); alkoxy silanes having a mercapto group (e.g., γ-mercaptopropy trimethoxysilane); and alkoxy silanes having a ureide group (e.g., γ-ureidepropyl triethoxysilane). Among these, in terms of making a reaction with organic residues residing adjacent to the metal compound-containing layer (gas barrier layer) quickly proceed, trialkoxy silane compounds having an amino group and trialkoxy silane compounds having a mercapto group are preferable, and in terms of making a chemical reaction with the inorganic layer compound in the metal compound-containing layer (gas barrier layer) quickly proceed, it is more preferable that the alkyl group in a trialkoxy silyl group be a methyl group.

The aziridine compound is not particularly limited and may be suitably selected in accordance with the intended use. Examples thereof include trimethylolpropane tris(3-aziridinylpropionate), trimethylolpropane tris[3-(2-methyl-aziridinyl)-propionate], trimethylolpropane tris(2-aziridinylbutylate), tris(1-aziridinyl)phosphine oxide, pentaerythritol tris-3-(1-aziridinylpropionate), pentaerythritol tetrakis-3-(1-aziridinylpropionate), and 1,6-bis(1-aziridinocarbamoyl) hexamethylene diamine.

The isocyanate compound is not particularly limited and may be suitably selected in accordance with the intended use. Examples thereof include aliphatic or alicyclic diisocyanates (e.g., hydrogenated toluene diisocyanate, hydrogenated xylylene diisocyanate, hydrogenated 4,4'-diisocyanate diphenylmethane, hexamethylenediisocyanate (HDI), isophoronediisocyanate (IPDI), and xylylenediisocyanate (XDI)); trifunctional or higher polyfunctional polyisocyanate compounds (e.g., burette type, isocyanurate type and adduct type derivatives of the aliphatic or alicyclic diisocyanates); aliphatic isocyanate compounds (e.g., various oligomers and polymers containing isocyanates); aromatic diisocyanates (e.g., phenylenediisocyanate (PDI), toluene diisocyanate (TDI), nephthalene diisocyanate (NDI), 4,4'-diisocyanate diphenylmethane (MDI); trifunctional or higher polyfunctional polyisocyanates (e.g., burette type, isocyanurate type and adduct type derivatives of the aromatic diisocyanates); and aromatic isocyanates compounds (e.g., various oligomers and polymers containing isocyanate). To form the metal compound-containing layer (gas barrier layer), it is preferable to prevent the gas barrier coating composition from reacting with water so that the hardening of the composition proceeds after formation of a film because the gas barrier coating composition basically contains water as a solvent, in relation to be used together with a water-soluble polymer. Therefore, as the isocyanate compound, a self-emulsifying type polyisocyanate compound, which exists in a water-dispersed state having a skeleton in to which a hydrophilic group is introduced, is preferable.

The carbodiimide compound is not particularly limited and may be suitably selected in accordance with the intended use. A carbodiimide compound of water-dispersible emulsion type is preferable. The hydrophilic modification of the carbodiimide compound is not particularly limited and may be suitably selected in accordance with the intended use. In terms of the excellence in stability and balance of crosslinkability, preferred is a material in which, an isocyanate-terminated carbodiimide compound and a polyol compound are subjected to urethane-forming reaction to extend the molecular chains, and the molecular terminates are hydrophilic modified with a hydrophilic oligomer.

<<Formation of Metal Compound-Containing Layer (Gas Barrier Layer)>>

The method of forming the metal compound-containing layer (gas barrier layer) is not particularly limited, as long as the reversible thermosensitive composition can be applied, and may be suitably selected in accordance with the intended use. For example, a method of coating the reversible thermosensitive composition and heat-drying is exemplified.

The coating method of the reversible thermosensitive composition is not particularly limited and may be suitably selected in accordance with the intended use. Examples of the coating method include a roll coating method using a gravure cylinder etc.; a doctor knife method, an air knife/nozzle coating method, a bar coating method, a spray coating method, and a dip coating method. These methods may be used alone or in combination.

In the metal compound-containing layer (gas barrier layer), the inorganic layer compound is preferably dispersed so as to be arranged in parallel along the metal compound-containing layer (gas barrier layer). From this point, when the metal compound-containing layer (gas barrier layer) is formed by the above-mentioned coating method of the reversible thermosensitive composition, the inorganic layer compound is easily dispersed so as to be arranged in parallel along the metal compound-containing layer (gas barrier layer).

In the case where the metal compound-containing layer (gas barrier layer) is formed by the above coating method, as a method of producing a reversible thermosensitive composition for coating, the following methods are exemplified:

(1) A method in which an inorganic layer compound (which may be preliminarily swollen/cleaved in a dispersion medium such as water.) is added to and mixed with a solution in which a resin (gas barrier resin) and an organic metal compound have been dissolved, and then the inorganic layer compound is dispersed using a stirrer or a dispersing machine; and (2) a method in which an inorganic layer compound is made swollen and cleaved in a dispersion medium, such as water, to prepare a dispersion liquid (dispersed solution), and a solution in which a gas barrier resin and an organic metal compound have been dissolved in a solvent, is further added to and mixed with the dispersion liquid. In addition, when the inorganic layer compound is a natural product, it is preferable that a compound containing, for example, alkali metal ions (e.g., magnesium hydroxide, and calcium hydroxide) or alkali earth metal ions be added into the above mixture liquid.

The solvent for dissolving the resin and the organic metal compound is not particularly limited and may be suitably selected in accordance with the intended use. Examples thereof include any water-soluble and water-insoluble solvents each capable of dissolving a polyvinyl alcohol polymer and/or an ethylene-vinyl alcohol copolymer and an organic metal compound. Among these solvents, water is preferable for the harmlessness to environments. Note that for the ethylene-vinyl alcohol copolymer, it is preferable to use it in combination with a lower alcohol having 2 to 4 carbon atoms, in order to impart solubility.

When the ethylene-vinyl alcohol copolymer is used as a resin, it is preferable that a gas barrier-resin solution be prepared using a mixture solvent containing a terminate-modified ethylene-vinyl alcohol copolymer which is made to have a low-molecular weight by treating with a peroxide etc., water and a lower alcohol. In this case, it is preferable to use a mixture solvent containing water in an amount of 50% by mass to 85% by mass, and a lower alcohol having 2 to 4 carbon atoms in an amount of 15% by mass to 50% by mass for improving the solubility of the ethylene-vinyl alcohol copolymer and maintaining an appropriate solid content thereof.

When the amount of the lower alcohol contained in the mixture solvent is more than 50% by mass, the cleavage of the inorganic layer compound may be insufficient, if the inorganic layer compound is dispersed in the mixture solvent.

The lower alcohol having 2 to 4 carbon atoms is not particularly limited and may be suitably selected in accordance with the intended use. Examples thereof include ethyl alcohol, n-propyl alcohol, iso-propyl alcohol, n-butyl alcohol, iso-butyl alcohol, sec-butyl alcohol, and tert-butyl alcohol. These may be used alone or in combination.

Among these, n-propyl alcohol, and iso-propyl alcohol are preferable.

The stirrer and dispersing machine for use in forming the reversible thermosensitive composition is not particularly limited, as long as it is a typical stirrer and a dispersing machine which are capable of uniformly dispersing the inorganic layer compound in the dispersion liquid, and may be suitably selected in accordance with the intended use. It is, however, preferably a high-pressure dispersing machine, a ultrasonic wave dispersing machine etc. are preferable in terms of capability of obtaining a transparent and stable inorganic layer compound-containing dispersion liquid. The high-pressure dispersing machine is not particularly limited and may be suitably selected in accordance with the intended use. Examples thereof include a NANOMIZER (manufactured by Nanomizer Co., Ltd.), MICRO-FLYDIZER (manufactured by Microflydex Co., Ltd), an ALTIMIZER (manufactured by Sugino Machine Co., Ltd.), a DeBee homogenizer (manufactured by Bee Co., Ltd.), and a NIRO SOAVI homogenizer (manufactured by Niro Soavi S.p.A.). The pressure condition of the high-pressure dispersing machine is not particularly limited and may be suitably selected in accordance with the intended use. It is, however, preferably 1 MPa to 100 MPa. When the pressure of the high-pressure dispersing machine is lower than 1 MPa, it may cause a problem that the dispersion process of the inorganic layer compound does not proceed and this requires a considerable amount of time. When the pressure is higher than 100 MPa, the inorganic layer compound is easily broken down, exceedingly finely pulverized and the gas passage length is shortened, possibly causing degradation in the gas barrier properties which are the object of forming the gas barrier layer.

The silane coupling agent, isocyanate compound, aziridine compound and carbodiimide compound, which are adhesion improvers to be added for improving the adhesion of the metal compound-containing layer (gas barrier layer) to adjacent layers may be added after preparation of a dispersion liquid containing the resin (gas barrier resin) and the inorganic layer compound. By thusly forming the metal compound-containing layer (gas barrier layer), the gas barrier properties of the thermoreversible recording medium are greatly improved and the durability thereof against peel-off caused by influence of moistures and the like is also increased.

<Protective Layer>

The protective layer is a layer provided as the outermost surface layer of the thermoreversible recording medium, i.e., a layer provided outside the metal compound-containing layer (gas barrier layer). The protective layer has strength, abrasion resistance and resistance to heat deformation.

The thickness of the protective layer is not particularly limited and may be suitably selected in accordance with the intended use. It is, however, preferably from 0.1 μm to 10 μm.

The material of the protective layer is not particularly limited and may be suitably selected in accordance with the intended use. However, resin curable by heat, ultraviolet ray, and an electron beam (described in Japanese Patent Application Laid-Open (JP-A) No. 02-566) are preferable.

Among these resins, it is preferable to use a resin curable by ultraviolet ray. The resin curable by ultraviolet ray is not particularly limited and may be suitably selected in accordance with the intended use. Examples thereof include urethane acrylate-based, epoxy acrylate-based, polyester acrylate-based, polyether acrylate-based, vinyl-based, and unsaturated polyester-based oligomers; and monomers of various monofunctional or polyfunctional acrylates, methacrylates, vinyl esters, ethylene derivatives and allyl compounds. When the resin is crosslinked using ultraviolet ray, a photopolymerization initiator or a photopolymerization accelerator may be used. When the resin is crosslinked by heat, a thermosetting resin using an isocyanate compound etc. as a crosslinking agent, for example, a resin having a group reactive to crosslinking agents (e.g., acryl polyol resin, polyester polyol resin, polyurethane polyol resin, polyvinyl butyral resin, cellulose acetate propionate, and cellulose acetate butyrate) or a resin obtained by copolymerization of a crosslinking agent with a monomer having a group reactive to the crosslinking agent may be used.

The protective layer may contain an organic filler, an inorganic filler, a ultraviolet absorber, a lubricant, a coloring pigment, and the like.

The organic filler is not particularly limited and may be suitably selected in accordance with the intended use. Examples thereof include silicone resins, cellulose resins, epoxy resins, nylon resins, phenol resins, polyurethane resins, urea resins, melamine resins, polyester resins, polycarbonate resins, styrene-based resins, acryl-based resins, polyethylene resins, formaldehyde-based resins, and polymethyl methacrylate resins.

The inorganic filler is not particularly limited and may be suitably selected in accordance with the intended use. Examples thereof include carbonates, silicates, metal oxides, and sulfuric acid compounds.

The ultraviolet absorber is not particularly limited and may be suitably selected in accordance with the intended use. Examples thereof include compounds having a salicylate structure, compounds having a cyanoacrylate structure, compounds having a benzotriazole structure, and compounds having a benzophenone structure.

The lubricant is not particularly limited and may be suitably selected in accordance with the intended use. Examples thereof include synthetic waxes, plant waxes, animal waxes, higher alcohols, higher fatty acids, higher fatty acid esters, and amides.

<Thermosetting Resin-Containing Layer (Primer Layer)>

The thermosetting resin-containing layer (primer layer) is a layer for improving adhesiveness and adhesion between the metal compound-containing layer (gas barrier layer) and the protective layer and contains a hardened product of a thermosetting resin composition having high affinity with the metal compound-containing layer (gas barrier layer) and the protective layer. The thermosetting resin-containing layer may be cured (hardened) after a mixed composition (thermosetting resin composition) containing a thermosetting resin and a curing agent (crosslinking agent) is applied onto the metal compound-containing layer (gas barrier layer).

A combination of the thermosetting resin and the curing agent is not particularly limited and may be suitably selected in accordance with the intended use. Examples thereof include a combination of a polyvinyl butyral resin with isocyanate, a combination of an acryl polyol resin with isocyanate, a combination of a polyester polyol resin with isocyanate, a combination of a polyurethane polyol resin with isocyanate, a combination of a phenoxy resin with isocyanate, and a combination of a polyvinyl butyral resin with isocyanate. Among these, a combination of a polyvinyl butyral resin with isocyanate is preferable.

The isocyanate is not particularly limited and may be suitably selected in accordance with the intended use. Examples thereof include tolylene diisocyanate (TDI), 4,4'-diphenylmethane diisocyanate (MDI), xylylene diisocyanate (XDI), naphthylene diisocyanate (NDI), paraphenylene diisocyanate (PPDI), tetramethylxylylene diisocyanate (TMXDI), hexamethylene diisocyanate (HDI), dicyclohexylmethane diisocyanate (HMDI), isophorone diisocyanate (IPDI), lysine diisocyanate (LDI), isopropylidenbis(4-cyclohexylisocyante) (IPC), cyclohexyl diisocyanate (CHDI), and tolidine diisocyanate (TODI).

The thickness of the thermosetting resin-containing layer is not particularly limited and may be suitably selected in accordance with the intended use. It is, however, preferably 0.1 μm to 3 μm, and more preferably 0.2 μm to 2 μm. When the thickness of the thermosetting resin-containing layer is less than 0.1 μm, the adhesiveness between the metal compound-containing layer (gas barrier layer) and the protective layer may not be sufficiently exhibited. When the thickness of the metal compound-containing layer (gas barrier layer) is more than 3 μm, the thickness of the thermoreversible recording medium may be unintendedly increased, although the adhesiveness between the metal compound-containing layer (gas barrier layer) and the protective layer cannot be further improved.

<Anchor Layer>

The first purpose of forming the anchor layer is to strengthen the bonding between the thermoreversible recording layer and the metal compound-containing layer (gas barrier layer), and the material of the anchor layer is selected from materials that will not change the properties of the thermoreversible recording medium at the time of coating or during use or storage of the thermoreversible recording medium.

The method of forming the anchor layer is not particularly limited and may be suitably selected in accordance with the intended use. For example, typical coating methods and typical laminating methods are exemplified.

The thickness of the anchor layer is not particularly limited and may be suitably selected in accordance with the intended use. It is, however, preferably 0.1 μm to 10 μm, and more preferably 0.1 μm to 3 μm.

When the thickness of the anchor layer is less than 0.1 μm, the adhesiveness thereof may become insufficient, and when it is more than 10 μm, the thermal sensitivity of the recording layer may degrade.

When the metal compound-containing layer (gas barrier layer) is formed on thermoreversible recording layer, first, an anchor agent containing a thermosetting resin is applied onto the thermoreversible recording layer to form a single layer or two or more layers, and subsequently the metal compound-containing layer (gas barrier layer) is formed. The anchor layer can be made to functions for improving the adhesiveness between the thermoreversible recording layer and the metal compound-containing layer (gas barrier layer), for preventing deterioration of the thermoreversible recording layer due to coating of the metal compound-containing layer (gas barrier layer), and preventing additives contained in the metal compound-containing layer (gas barrier layer) from transferring into thermoreversible recording layer or preventing additives contained in the thermoreversible recording layer from transferring into the metal compound-containing layer (gas barrier layer).

The anchor agent can be classified into additives and narrowly-defined anchor agents.

The adhesives are not particularly limited and may be suitably selected in accordance with the intended use. Examples thereof include various adhesives for lamination such as isocyanate-based, urethane-based, and acryl-based additives.

The narrowly-defined anchor agents are not particularly limited and may be suitably selected in accordance with the intended use. Examples thereof include various anchor coating agents for lamination such as titanium-based, isocyanate-based, imine-based, and polybutadiene-based anchor coating agents.

Note that these additives and narrowly-defined anchor agents may contain adhesiveness (adhesion) improving materials such as a crosslinking agent.

As for a solvent for use in a coating liquid of the anchor layer, a dispersing machine for dispersing the coating liquid, a binder, a coating method, a drying/hardening method of the coating liquid and the like, known coating methods used in the formation of the thermoreversible recording layer, the metal compound-containing layer (gas barrier layer) can be used.

The anchor layer preferably contains a hardened product of a thermosetting resin composition, like a reaction product obtained between an ester polyol resin and isocyanate, for example. Since this hardened product of the thermosetting resin composition is provided for firmly bonding the thermosensitive recording layer to the gas barrier layer, the hardened product is preferably obtained by applying the thermosetting resin composition in a state of a precursor of the thermosetting resin composition that has not yet been thermally set (e.g., an ester polyol resin and isocyanate) onto one of these layers (e.g., the thermosensitive recording layer) and thermally curing the composition.

In the case of an anchor layer containing a reaction product between an ester polyol resin and isocyanate, the mass ratio of isocyanate to the ester polyol resin is preferably set from 10:100 to 150:100. The thickness of the anchor layer is preferably adjusted from 0.1 μm to 10 μm. When the layer thickness is less than 0.1 μm, the adhesion force is insufficient. When the layer thickness is more than 10 μm, there is an effect of increasing the thickness of the reversible thermosensitive recording material, not increasing the adhesiveness, and this impairs the thermal conductivity and pliability of the reversible thermosensitive recording material.

<Undercoat Layer>

The undercoat layer is capable of preventing heat conduction from the thermoreversible recording layer toward the support when the thermoreversible recording layer is heated to dissolve the electron-donating color-forming compound (color former) and the electron-accepting compound (developer), capable of increasing the heating effect of the thermoreversible recording layer, and of preventing adverse influence upon the materials caused by an increase in temperature of the support. By increasing the heating effect of the thermoreversible recording layer, it is possible to reduce the amount of heat for dissolving the electron-donating color-forming compound (color former) and the electron-accepting compound (developer) and to shorten the dissolution time, and thus the reversible thermosensitive recording member can be colored and decolored in a short time with use of a small thermal head or a small heating roller. In addition, when the support is prevented from increasing in temperature, the material selection width of the support is increased, and there is no need to prevent a magnetic recording material to be mounted on the support and an electron component (e.g., IC) from increasing in temperature. Further, even when the temperature of the back surface of the support is increased in the production of the thermoreversible recording medium and during use of the thermoreversible recording medium, it is possible to reduce the influence of conduction of heat toward the thermoreversible recording layer.

Since the undercoat layer has an action of improving the adhesiveness and adhesion with adjacent layers (e.g., the support, and the thermoreversible recording layer), it is preferable to use a material excellent in affinity and adhesiveness with the adjacent layers.

Further, the undercoat layer is preferably a foamed layer for increasing the heat insulation. In formation of the foamed layer, an undercoat layer precursor such as urethane-based material may be foamed on the support to thereby provide an undercoat layer. Also, hollow particles (e.g., inorganic or organic foamable beads) and a binder resin etc. are used as undercoat layer materials, mixed and then provided on the support to form an undercoat layer on the support. By providing the layer containing the hollow particles, as an undercoat layer, between the thermoreversible recording layer and the support, high heat insulation can be obtained, the adhesion with a thermal head can be improved, and the color-forming sensitivity and temperature-sensing speed are increased.

The hollow particles are not particularly limited and may be suitably selected in accordance with the intended use. Examples thereof include microscopic hollow particles including a thermoplastic resin as a shell and internally including air and other gasses.

The average particle diameter (outer diameter of particles) t of the hollow particles is not particularly limited and may be suitably selected in accordance with the intended use. It is, however, preferably 0.4 μm to 10 μm. When the average particle diameter (outer diameter of particles) t of the hollow particles is smaller than 0.4 μm, a production problem, such as difficulty in obtaining a desired hollow rate, may occur. When the average particle diameter is greater than 10 μm, scratch-like streaks are easily formed during the coating on the support, the smoothness of the surface of the coated and dried thermosensitive recording medium is reduced, and thus the adhesion with a thermal head is decreased in image formation, which may leads to a reduction in the effect of improving sensitivity. For the same reason, as the hollow particles, those having a particle diameter within the above range and a relatively narrow particle distribution are preferable.

The hollow rate of the hollow particles is not particularly limited and may be suitably selected in accordance with the intended use. It is, however, preferably 30% to 98%, more preferably 70% to 98%, and particularly preferably 90% to 98%.

When the hollow particles have a high hollow rate, the thickness of a wall material thereof is reduced, the strength thereof relative to pressure and the like is weakened, and the hollow particles are easily broken down. When the wall material is simply solidified to make the hollow particles have high strength, the hollow particles tend to be brittle and easily broken down due to bending of the wall material. Accordingly, the wall material of the hollow particles needs to have a balance between solidity and flexibility. Acrylonitrile resins and methacrylonitrile resins are exemplified as preferable wall materials having solidity and flexibility. Specific examples of the hollow particles are described in Japanese Patent Application Laid-Open (JP-A) No. 2005-199704.

Note that the "hollow rate" is a ratio of the outer diameter to the internal diameter and represented by the following equation. As the hollow rate of the hollow particles, for example, a microscope image of the hollow particles is observed, and an internal diameter and an outer diameter of individual particles observed in the same direction are measured, and a hollow rate is calculated based on the following equation.

$$\text{Hollow rate}=[(\text{Internal diameter of hollow particle})/(\text{Outer diameter of particle})]\times 100$$

In the measurement of the hollow rate, the hollow rate is calculated as a number average hollow rate of hollow particles which are dispersed, as paved in an area of at least 100 micron-square or larger. Note that in the present invention, the measurement method of particle diameters of the hollow particles is according to a laser method, similarly to the above-mentioned measurement method of a leuco dye.

As a material for the undercoat layer, known resins may be used in combination. The known resins are not particularly limited and may be suitably selected in accordance with the intended use. Examples thereof include a styrene-butadiene copolymer as a hydrophobic resin, latexes of a styrene/butadiene/acryl ester copolymer, and emulsions of vinyl acetate, a vinyl acetate/acrylic acid copolymer, a styrene/acryl ester copolymer, an acryl ester resin, and a polyurethane resin. In addition to the above, water-soluble resins such as completely saponified polyvinyl alcohol and various modified polyvinyl alcohols (e.g., carboxy-modified polyvinyl alcohol, partially saponified polyvinyl alcohol, sulfonic acid-modified polyvinyl alcohol, silyl-modified polyvinyl alcohol, acetoacetyl-modified polyvinyl alcohol and diacetone-modified polyvinyl alcohol are exemplified. In the undercoat layer, when necessary, auxiliary additive components which are commonly used in thermosensitive recording materials (e.g., a filler, thermofusible components, and surfactant) can be used together with the hollow particles and the binder.

It is also preferable to add coloring raw materials containing white or black color to the undercoat layer.

When the undercoat layer is colored as a primary coat color of the thermoreversible recording layer, there is no restriction to the color of the support on the thermoreversible recording layer side.

<Ultraviolet Absorbing Layer>

The ultraviolet absorbing layer is a layer for protecting the thermoreversible recording layer against exposure to ultraviolet rays. When the materials used in the thermoreversible recording layer, particularly, the electron-donating color-forming compound (color former) and the electron-accepting compound (developer) are exposed to ultraviolet rays for a long time, they are deteriorate to be discolored, color-faded, and will not undergo an adequate color-forming reaction. For this reason, the thermosensitive recording layer is preferably protected against exposure to unnecessary ultraviolet rays. For example, in the thermoreversible recording medium, an ultraviolet absorbing layer is provided between the thermoreversible recording layer and the anchor layer.

The material of the ultraviolet absorbing layer is not particularly limited, as long as it absorbs ultraviolet rays, and may be suitably selected in accordance with the intended use.

Examples thereof include resins for anchor layer, to which a filler having ultraviolet absorbability is added.

The filler is not particularly limited and may be suitably selected in accordance with the intended use. Examples thereof include inorganic fillers and organic fillers. These may be used alone or in combination.

The inorganic filler is not particularly limited and may be suitably selected in accordance with the intended use. Examples thereof include calcium carbonate, magnesium carbonate, silicic anhydride, hydrosilicon, hydrosilicon aluminum, hydrosilicon calcium, alumina, iron oxide, calcium oxide, magnesium oxide, chrome oxide, manganese oxide, silica, talc, and mica.

The organic filler is not particularly limited and may be suitably selected in accordance with the intended use. Examples thereof include silicone resins, cellulose resins, epoxy resins, nylon resins, phenol resins, polyurethane resins, urea resins, melamine resins, polyester resins, polycarbonate resins; styrene-based resins (e.g., styrene, polystyrene, polystyrene.isoprene, and styrene vinyl benzene); acryl-based resins (e.g., vinylidene acryl chloride, acryl urethane, and acryl ethylene); polyethylene resins; formaldehyde-based resins (e.g., benzoguanamine formaldehyde, and melamine formaldehyde); polymethyl methacrylate resins, and vinyl chloride resins.

The shape of the filler is not particularly limited and may be suitably selected in accordance with the intended use. For example, spherical shape, granular shape, plate-like shape, and needle-like shape are exemplified.

The amount of the filler contained in the ultraviolet absorbing layer is not particularly limited and may be suitably selected in accordance with the intended use. It is, however, preferably 5% by volume to 50% by volume on a volume fraction basis.

The thickness of the ultraviolet absorbing layer is not particularly limited and may be suitably selected in accordance with the intended use. It is, however, preferably 0.1 μm to 20 μm. When the thickness of the ultraviolet absorbing layer is less than 0.1 μm, the ultraviolet absorption may be insufficient, and when the thickness is more than 20 μm, the ultraviolet absorbability and the thermal conductivity may degrade.

In the thermoreversible recording medium of the present invention, various additives can be used as required. The additives are not particularly limited and may be suitably selected in accordance with the intended use. Examples thereof include dispersants, surfactants, conducting agents, fillers, lubricants, antioxidants, light stabilizers, ultraviolet absorbers, coloring stabilizers, and decoloring stabilizers.

In each of the thermoreversible recording layer, the anchor layer, and the metal compound-containing layer (gas barrier layer), a filler having ultraviolet absorbability (having no ultraviolet-shielding ability) may be added. The filler is not particularly limited and may be suitably selected in accordance with the intended use. Examples thereof are the fillers listed above as the ultraviolet absorbers. These fillers may be used alone or in combination.

The shape of the filler is not particularly limited and may be suitably selected in accordance with the intended use. For example, spherical shape, granular shape, plate-like shape, and needle-like shape are exemplified.

The amount of the filler contained in the metal compound-containing layer (gas barrier layer) is not particularly limited and may be suitably selected in accordance with the intended use. It is, however, preferably 5% by volume to 50% by volume on a volume fraction basis.

In each of the thermoreversible recording layer, the anchor layer, and the metal compound-containing layer (gas barrier layer), a lubricant may be added.

The lubricant is not particularly limited and may be suitably selected in accordance with the intended use. Examples thereof include synthetic waxes (e.g., ester wax, paraffin wax, and polyethylene wax); plant waxes (e.g., castor hardened oil); animal waxes (e.g., beef tallow hardened oil); higher alcohols (e.g., stearyl alcohol, and behenyl alcohol); higher fatty acids (e.g., margaric acid, lauric acid, mesitylenic acid, palmitic acid, stearic acid, behenic acid, and formic acid); higher fatty acid esters (e.g., fatty acid ester of sorbitan); and amides (e.g., stearic amide, oleic amide, lauric amide, ethylene bis-stearic amide, methylene bis-stearic amide, and methylol stearic amide).

The amount of the lubricant contained each of these layers is not particularly limited and may be suitably selected in accordance with the intended use. It is, however, preferably 0.1% by volume to 95% by volume, and more preferably 1% by volume to 75% by volume on a volume fraction basis.

A magnetic recording layer and an IC chip may also be provided on the circumference, the back surface, the internal side etc. of the support of the thermoreversible recording medium of the present invention. When an IC chip is provided with the thermoreversible recording medium of the present invention, it can also be used as an IC card and an IC tag. In addition, a magnetic recording layer is provided with the thermoreversible recording medium of the present invention, it can also be used as a magnetic card. Besides the above, the thermoreversible recording medium can be provided on both surfaces of one sheet of the support, and an adhesive layer etc. can also be provided on the opposite side of the support.

First Embodiment

The structure of a thermoreversible recording medium according to a first embodiment of the present invention is illustrated in FIG. 1. FIG. 1 is a partially cross-sectional view schematically illustrating a thermoreversible recording medium of the present invention. In FIG. 1, in a thermoreversible recording medium 1, on a surface of a sheet-shaped support 2, a thermosensitive recording layer 3, a gas barrier layer 4, a primer layer 8, and a protective layer 5 are laminated in this order.

The thermosensitive recording layer 3 is laminated, at its underside surface, on the support 2 having sufficient gas barrier properties and is coated, at its upper side surface, with the gas barrier layer 4, and thus thermosensitive recording layer 3 is designed so that both surfaces thereof are not directly contacted with outside air. In principle, the thermoreversible recording medium is sufficient to have a layer made of a thermosensitive recording material capable of repeating color forming and decoloring. However, the color former and developer used in the thermosensitive recording layer 3 are susceptible to be affected by light, and particularly in a state of being activated by light, they easily cause a radical reaction with oxygen. When a radical reaction occurs, the thermosensitive recording layer 3 in a colored state may be decolored and color-faded, and the thermosensitive recording layer 3 in a decolored state may develop a color (e.g., yellow discoloration). The gas barrier layer 4 is provided for preventing oxygen in outside air from entering into the thermosensitive recording layer 3. The primer layer 8 has an effect of improving the adhesion between the gas barrier layer 4 and the protective layer 5, and an effect of preventing interlayer separation between the gas barrier layer 4 and the protective layer 5. The protective layer 5 has a function to prevent the surfaces of the gas barrier layer 4 and the thermosensitive recording layer 3 from deforming to produce so-called beaten traces due to heat and pressure from a thermal head when the thermoreversible recording medium 1 is printed with the thermal head at the time of recording. The protective layer 5 preferably has a function to protect the surface of the thermoreversible recording medium against mechanical stress and moistures.

Second Embodiment

Figure 2:
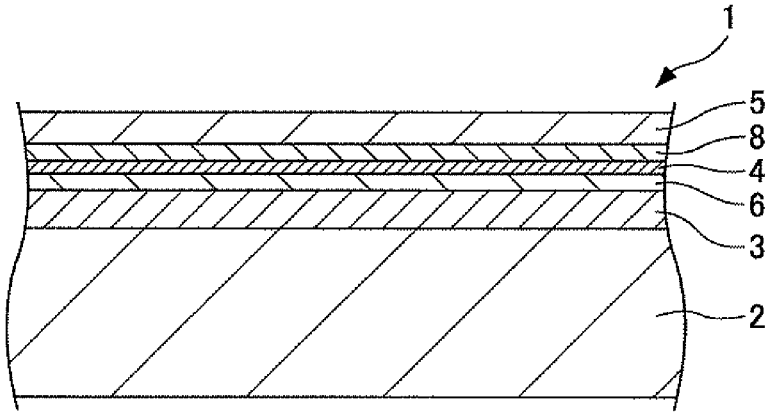
FIG. 2 is a partially cross-sectional view schematically illustrating a thermoreversible recording medium according to the present invention (second).

The structure of a thermoreversible recording medium according to a second embodiment of the present invention is illustrated in FIG. 2. FIG. 2 is a partial cross-sectional view schematically illustrating a thermoreversible recording medium of the present invention. In FIG. 2, a different point of a thermoreversible recording medium 1 according to the second embodiment from thermoreversible recording medium 1 according to the first embodiment is to provide an anchor layer (intermediate layer) 6 between the thermosensitive recording layer 3 and the gas barrier layer 4. The anchor layer (intermediate layer) 6 is provided for the purpose of improving the adhesiveness between the thermosensitive recording layer 3 and the gas barrier layer 4 and further improving the repeatability of color-forming and decoloring. For the thermoreversible recording medium 1 according to the second embodiment, only this difference point is described. Other points thereof are same as those of the thermoreversible recording medium 1 according to the first embodiment.

Third Embodiment

Figure 3:
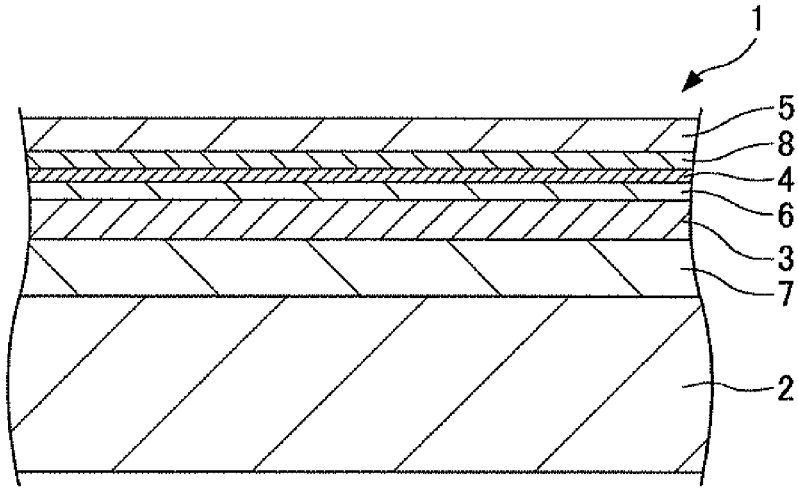
FIG. 3 is a partially cross-sectional view schematically illustrating a thermoreversible recording medium according to the present invention (third).

The structure of a thermoreversible recording medium according to a third embodiment of the present invention is illustrated in FIG. 3. FIG. 3 is a partial cross-sectional view schematically illustrating a thermoreversible recording medium of the present invention. In a thermoreversible recording medium 1 according to the third embodiment illustrated in FIG. 3, an undercoat layer 7 having high insulation is provided between the thermosensitive recording layer 3 and the support 2 of the thermoreversible recording medium 1 illustrated in FIG. 2.

Fourth Embodiment

Figure 4:
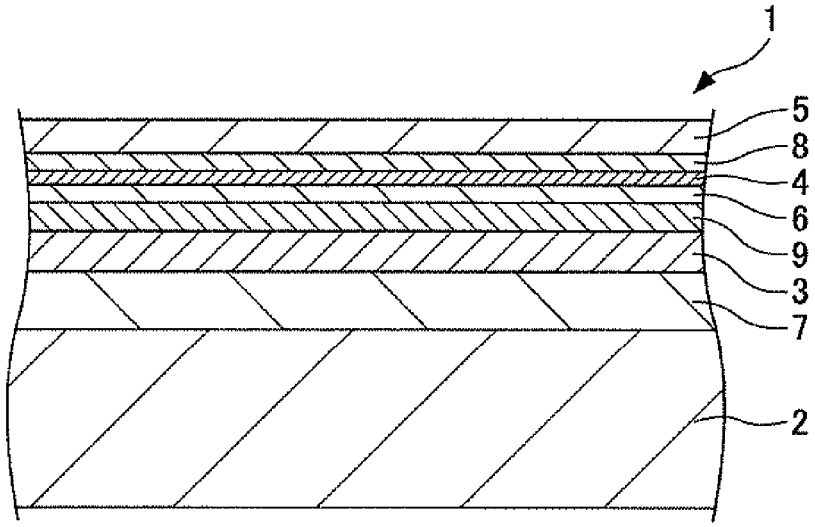
FIG. 4 is a partially cross-sectional view schematically illustrating a thermoreversible recording medium according to the present invention (fourth).

The structure of a thermoreversible recording medium according to a fourth embodiment of the present invention is illustrated in FIG. 4. FIG. 4 is a partial cross-sectional view schematically illustrating a thermoreversible recording medium of the present invention. In a thermoreversible recording medium 1 according to the fourth embodiment in FIG. 4, an ultraviolet absorbing layer 9 for protecting the thermosensitive recording layer 3 against ultraviolet rays is provided between the thermosensitive recording layer 3 and the anchor layer 6 of the thermoreversible recording medium 1 according to the third embodiment illustrated in FIG. 3.

Fifth Embodiment

The thermoreversible recording medium of the present invention may also be attached to another medium via an adhesion layer or the like. Alternatively, a back coat layer is provided on a one surface (back surface) of a support such as a PET film, a peel-off layer used for a thermal transfer ribbon is provided on the surface of the support opposite to the back coat layer, a thermoreversible recording layer is provided on the peel-off layer, and a resin layer capable of transferring to paper, a resin film, a PET film etc. is further provided on a surface of the thermoreversible recording layer to produce a thermoreversible recording medium. On the resin layer, an image may be transferred using a thermal transfer printer. The thermoreversible recording medium of the present invention may be processed in the form of a sheet or in the form of a card. It can be processed in an arbitrarily shape. In addition, the thermoreversible recording medium can undergo printing process on the front surface or back surface thereof. On a thermoreversible recording medium processed in the form of a card, a magnetic layer or an IC chip can also be loaded to prepare a magnetic card or an IC card. Further, the thermoreversible recording medium of the present invention can be made as a double-sided thermoreversible recording medium, and a non-reversible thermosensitive recording layer may be used in combination. In this case, the color tones of each of the recording layers may be identical or different.

<Image Formation/Image Erasure on Thermoreversible Recording Medium>

As a method of forming an image and erasing the image on the thermoreversible recording medium of the present invention, conventional image formation methods utilizing a color forming method and an erasing method on a thermoreversible recording medium through the use of a thermal pen, a thermal head, a laser heating or the like can be used.

Figure 7:
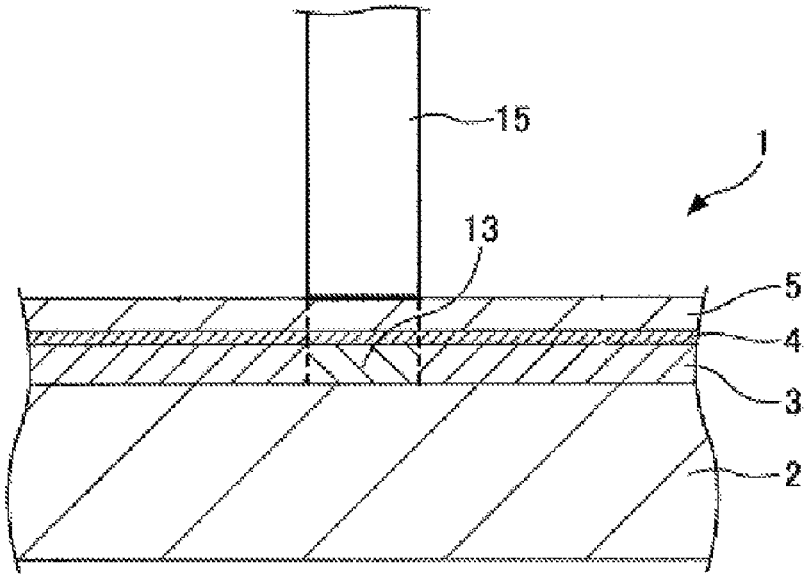
FIG. 7 is a view illustrating a method of forming a color of a thermoreversible recording medium according to the present invention.
Figure 8:
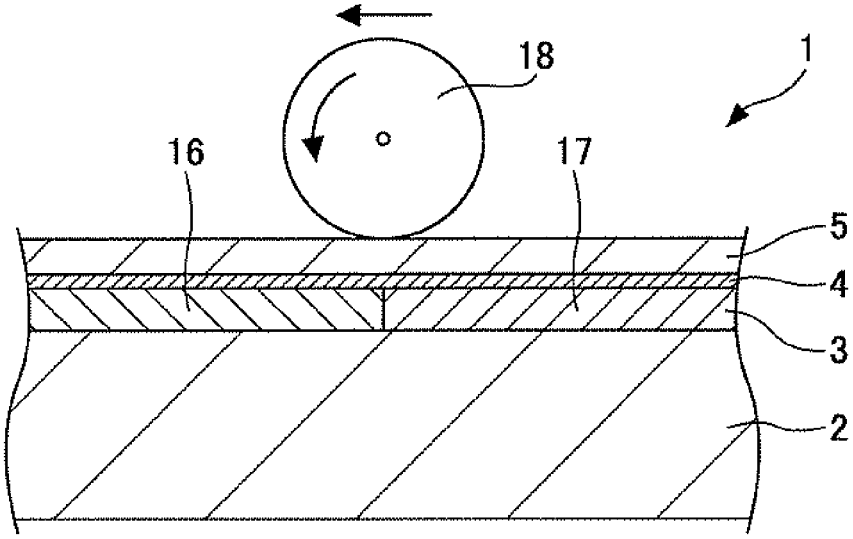
FIG. 8 is a view illustrating a method of erasing a color of a thermoreversible recording medium according to the present invention.

FIG. 7 is a view illustrating a method of forming a color of a thermoreversible recording medium according to the present invention, and FIG. 8 is a view illustrating a method of erasing a color of a thermoreversible recording medium according to the present invention.

The method of forming a color of the thermoreversible recording medium 1 of the present invention will be described below, with reference to FIG. 7.

First, a heating head 15 having a small surface area, like a thermal head of a dot printer, is pressed against a surface of a thermoreversible recording medium 1 which is not yet colored. Since a thermoreversible recording layer 3, a barrier layer 4 and a protective layer 5 are formed to be thin, a heat target portion 13 of the thermoreversible recording layer 3 is heated quickly to reach the melting point of a color former etc. constituting the thermosensitive recording layer 3. Then, the color former and a developer in the heat target portion 13 of the thermoreversible recording layer 3 facing the heating head 15 are melted and reacted to form a color. Then, the heating head 15 is removed from the surface of the thermoreversible recording medium 1, and the heat target portion 13 is cooled soon because the area of the heat target portion 13 is substantially small. Then, the heat target portion 13 becomes in a frozen state with maintaining its color.

The method of erasing a color of the thermoreversible recording medium of the present invention will be described below, with reference to FIG. 8.

First, a surface of a thermoreversible recording medium 1 is heated to melt a heat target area of a thermoreversible recording layer 3. At this stage, it is preferable to heat a relatively large area of the thermoreversible recording layer 3 is heated with a heating roller 18, for example, as illustrated in FIG. 8, not heating a small area as heated by the thermal head described above. After the heat target area of the thermoreversible recording layer 3 is melted, the heat target area is moved by rolling the heating roller 18. Then, the heat target area that has been melted and color-formed once is relatively slowly cooled. In the meanwhile, a color former and a developer in the thermoreversible recording layer 3 are dissociated from each other, and each of them is agglomerated or crystallized. Therefore, the thermoreversible recording layer 3 is decolored and then cooled to normal temperature to be in a frozen state. By this color erasing (decoloring) method, not-colored portions are also heated. Usually, color erasure is sufficient to discharge the color of the whole of a thermoreversible recording medium, and thus it is convenient to use this method. In FIG. 8, if the heating roller 19 rolls one the left side of the figure, along the direction indicated by the arrow, an unheated portion 16 of the thermosensitive recording layer 3 which is in a colored state is heated with the movement of the heating roller 18 and then slowly cooled to thereby become a color-erased area 17.

(Thermoreversible Recording Member)

A thermoreversible recording member according to the present invention has an information storage unit and a reversible display unit, and the reversible display unit includes the thermoreversible recording medium of the present invention and further includes other members as required.

The reversible display unit capable of reversibly display and the information storage unit are provided (integrated) on a same card, and a part of information stored in the information storage unit is displayed on the reversible display unit. With this, an owner of the card can confirm the information only by looking at the card without having a special device, and thus it is excellent in convenience. In addition, when the contents in the information storage unit is rewritten (changed), the thermoreversible recording member can be used repeatedly any number of times by erasing and rewriting the display of the reversible display unit.

The members having an information storage unit and a reversible display unit are broadly classified into the following two types:

(1) A part of a member having an information storage unit is used as a support of a reversible thermosensitive recording material, and a thermosensitive recording layer is directly formed thereon.

(2) A surface of a support in a thermoreversible recording member, which is separately formed and has a thermosensitive recording layer on the support is bonded to a member having an information recording unit.

In the case of reversible thermosensitive recording members of (1) and (2) above, they need to be set so as to exhibit each function of the information storage unit and the reversible display unit, and if so, as positions for mounting the information storage unit, it can be provided on a surface of the support opposite to a surface provided with the thermosensitive recording layer in the thermoreversible recording member, and can also be provided between the support and the thermosensitive recording layer, or can be provided on a part of the thermosensitive recording layer.

The information storage unit is not particularly limited and may be suitably selected in accordance with the intended use. The information storage unit is, however, preferably a magnetic thermosensitive recording layer, a magnetic stripe, an IC memory, an optical memory, a hologram, an RF-ID tag card, a disk, a disk cartridge or a tape cassette. Particularly in a sheet medium which is larger in size than a card, an IC memory and an RF-ID tag are preferable. Note that the RF-ID tag is composed of an IC chip, and an antenna connected to the IC chip.

EXAMPLES

Hereinafter, the present invention will be described in detail with reference to Examples and Comparative Examples, the following Examples, however, however shall not be construed as limiting the scope of the present invention.

Note that in the following examples, the unit "part(s) and the unit "%" are on a mass basis unless otherwise specified,

Example 1

Production of Thermoreversible Recording Medium

—Support—

As a support, a white turbid polyester film having a thickness of 125 μm (TETLON FILM U2L98W, produced by TEIJIN DUPONT FILMS JAPAN LTD.) was used.

—Formation of Undercoat Layer—

A styrene-butadiene copolymer (PA-9159, produced by Japan A & L Company Ltd.) (30 parts by mass), a polyvinyl alcohol resin (POVAL PVA103, produced by KURARAY Co., Ltd.) (12 parts by mass), hollow particles (MICRO SPHERE R-300, produced by Matsumoto Yushi Seiyaku Co., Ltd.) (20 parts by mass), and water (40 parts by mass) were added, and stirred for about 1 hour until the components were in a uniform state to prepare an undercoat layer coating liquid. The thus obtained undercoat layer coating liquid was applied onto the support by a wire bar, and then heated for drying at 80° C. for 2 minutes to form an undercoat layer having a thickness of 20 μm.

—Formation of Thermoreversible Recording Layer—

An electron-accepting compound (developer) represented by the following structural formula (3 parts by mass), dialkyl urea (produced by Nippon Kasei Chemical Co., Ltd., HAKREEN SB) (1 part by mass), a 50% by mass acryl polyol-containing methylethylketone solution (LR327, produced by Mitsubishi Rayon Co., Ltd.) (9 parts by mass), and methylethylketone (70 parts by mass) were pulverized by a ball mill so as to have an average particle diameter of 1 μm, thereby preparing a dispersion liquid.

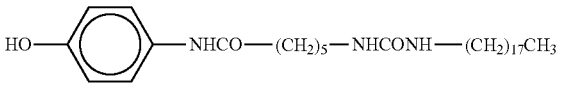

Next, in the dispersion liquid containing the pulverized electron-accepting compound (developer), 2-anilino-3-methyl-6-di(n-butylamino)fluoran as an electron-donating color-forming compound (color former) (1 part by mass), and isocyanate (CORONATE HL, Nippon Polyurethane Co., Ltd.) (3 parts by mass) were added and adequately stirred to obtain a thermoreversible recording layer coating liquid. The thus obtained thermoreversible recording layer was applied onto the undercoat layer by a wire bar, dried at 100° C. for 2 minutes, and then cured at 60° C. for 24 hours to thereby form a thermoreversible recording layer having a thickness of 11 μm.

—Formation of Ultraviolet Absorbing Layer—

A composition composed of a 40% by mass ultraviolet-absorbing polymer solution (UV-A11, hydroxyl value: 39, produced by Nippon Shokubai Co., Ltd.) (20 parts by mass), an isocyanate compound (D-110N, produced by Mitsui Takeda Polyurethane Co., Ltd.) (2 parts by mass), and methylethylketone (MEK) (18 parts by mass) was stirred in a ball mill to prepare an ultraviolet absorbing layer coating liquid having ultraviolet absorbability. The thus obtained ultraviolet absorbing layer coating liquid was applied onto the thermoreversible recording layer by a wire bar, dried at 90° C. for 1 minute, and then left standing at room temperature for 24 hours, thereby forming an ultraviolet absorbing layer having a thickness of 2 μm.

—Formation of Anchor Layer—

In ethyl acetate (125 parts by mass), a polyester polyol resin (TAKELAC A-3210, produced by Mitsui Chemicals Polyurethane Inc.) (15 parts by mass), and an isocyanate compound (TAKENATE A-3070, produced by Mitsui Chemical Polyurethane Co., Ltd.) (10 parts by mass) were added and mixed to obtain an anchor layer coating liquid. Thus obtained anchor layer coating liquid was applied onto the ultraviolet absorbing layer by a wire bar, dried at 80° C. for 1 minute, thereby forming an anchor layer having a thickness of 0.7 μm.

—Formation of Metal Compound-Containing Layer (Gas Barrier Layer)—

(1) Preparation of Ethylene-Vinyl Alcohol Copolymer Solution

In a mixture solvent containing 50% of purified water and 50% of alcohol (IPA) (60 parts by mass), an ethylene-vinyl alcohol copolymer (SOANOL D-2908, produced by Nippon Synthetic Chemical Industry Co., Ltd., which may be abbreviated as "EVOH") (30 parts by mass) were added, and further hydrogen peroxide water having a concentration of 30% by mass (10 parts by mass) was added, and heated at 80° C. while being stirred to react for about 2 hours. Subsequently, the reaction produced was cooled, and catalase was added thereto so as to be 3,000 ppm, followed by removing residues of hydrogen peroxide, to thereby obtain a substantially transparent ethylene-vinyl alcohol copolymer solution (solid content: 30% by mass).

(2) Preparation of Inorganic Layer Compound Dispersion Liquid

A natural product of montmorillonite as an inorganic layer compound (KUNIPIA F, from Kunimine Industries Co., Ltd.) (5 parts by mass) was added in purified water (95 parts by mass) while being stirred, and adequately dispersed by a high-speed stirrer. Thereafter, the temperature of the dispersion liquid was maintained at 40° C. for 1 day to thereby obtain an inorganic layer compound dispersion liquid (solid content: 5%).

(3) Preparation of Metal Compound-Containing Layer (Gas Barrier Layer) Coating Liquid and Formation of Metal Compound-Containing Layer (Gas Barrier Layer)

In a mixture solvent containing 50% of purified water and a 50% NPA (60.7 parts by mass), the ethylene vinyl alcohol copolymer solution prepared in (1) (15.7 parts by mass) was added and adequately stirred and mixed. Further, while this solution was stirred at high speed, the inorganic layer compound dispersion liquid prepared in (2) (23.6 parts) was added thereto. Cationic ion-exchanged resin particles (3 parts by mass) were added to this mixture solution (100 parts by mass), and stirred at a stirring speed of not causing fracture of the ion-exchanged resin particles for 1 hour, the cationic ions were then removed, and subsequently filtered out only the cationic ion-exchanged resin through a strainer. In the resulting mixture solution, magnesium hydroxide (0.06 parts by mass) was added, and further subjected to a dispersion treatment by a pressure-dispersing machine under a pressure of 50 MPa, followed by filtration through a 300-mesh filter, thereby obtaining a mixture solution of the ethylene-vinyl alcohol copolymer solution and the inorganic layer compound dispersion liquid (solid content: 5.9%) (EVOH/inorganic layer compound=80 parts/20 parts). While the thus obtained mixture solution (10 parts by mass) was stirred, a 44% titanium lactate solution (produced by Matsumoto Fine Chemical Co., Ltd., TC-310) as an organic metal compound (0.015 parts by mass) was added thereto, thereby obtaining a metal compound-containing layer (gas barrier layer) coating liquid. The thus obtained metal compound-containing layer (gas barrier layer) coating liquid was applied onto the anchor layer by a wire bar, dried at 80° C. for 1 minute, thereby forming a metal compound-containing layer (gas barrier layer) having a thickness of 0.5 μm.

Note that the Ti content of the thus formed metal compound-containing layer (gas barrier layer) was 0.2% by mass.

Further, the metal compound-containing layer (gas barrier layer) was identified using a scanning electron microscope (SEM) (ULTRA55, manufactured by Carl Zeiss), and the organic metal compound in the metal compound-containing layer (gas barrier layer) was identified by an X-ray analyzer (EMAX ENERGY, manufactured by HORIBA Ltd.)

—Formation of Thermosetting Resin-Containing Layer (Primer Layer)—

In a mixture liquid (50 parts by mass) containing methylethylketone (30% by mass), isopropyl alcohol (20% by mass) and ethyl acetate (50% by mass), a polyvinyl butyral resin (ESLEC BL-1, produced by Sekisui Kagaku Co., Ltd.) (50 parts by mass) was dissolved, and an isocyanate compound (hardener, LAMIOL R, produced by Sakata Inks Co.) (3 parts by mass) was mixed to obtain a thermosetting resin-containing layer (primer layer) coating liquid. The thus obtained thermosetting resin-containing layer (primer layer) coating liquid was applied onto the metal compound-containing layer (gas barrier layer) by a wire bar, dried at 80° C. for 1 minute, thereby forming a thermosetting resin-containing layer (primer layer) having a thickness of 0.8 μm.

Note that the thermosetting resin-containing layer (primer layer) was identified by a scanning electron microscope (SEM) (ULTRA55, from Carl Zeiss).

—Formation of Protective Layer—

Pentaerythritol hexaacrylate (KAYARAD DPHA, produced by Nippon Kayaku Co., Ltd.) (3 parts by mass), urethane acrylate oligomer (ART RESIN UN-3320HA, produced by Negami Kogyo K.K.) (3 parts by mass), acrylic acid ester of dipentaerythritol caprolactone (KAYARAD DPCA-120, produced by Nippon Kayaku Co., Ltd.) (3 parts by mass), silica (P-526, produced by Mizusawa Kagaku K.K.) (1 part), a photopolymerization initiator (IRGACURE184, produced by Nihon Chiba-Geigy K.K.) (0.5 parts by mass), a lubricant (ST102PA, produced by TORAY Dow Corning Silicone Co., Ltd.) (0.001 parts), and isopropyl alcohol (11 parts by mass) were added, adequately stirred in a ball mil and dispersed so as to have an average particle diameter of 3 μm to prepare a protective layer coating liquid. The thus obtained protective layer coating liquid was applied onto the thermosetting resin-containing layer (primer layer) by a wire bar, dried at 90° C. for 1 minute, and then exposed to light with a ultraviolet lamp of 80 W/cm so as to be crosslinked, followed by curing at 70° C. for 24 hours, thereby forming a protective layer having a thickness of 4 μm.

With the above procedures, a thermoreversible recording medium of Example 1 was produced. This thermoreversible recording medium corresponds to the thermoreversible recording medium of the fourth embodiment as illustrated in FIG. 4.

Example 2

A thermoreversible recording medium of Example 2 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, the titanium lactate solution (0.15 parts by mass) was added to the metal compound-containing layer (gas barrier layer) coating liquid.

Note that the Ti content of the thus formed metal compound-containing layer (gas barrier layer) was found to be 2.0% by mass.

Example 3

A thermoreversible recording medium of Example 3 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, the titanium lactate solution (0.3 parts by mass) was added to the metal compound-containing layer (gas barrier layer) coating liquid.

Note that the Ti content of the thus formed metal compound-containing layer (gas barrier layer) was found to be 4.2% by mass.

Example 4

A thermoreversible recording medium of Example 4 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, the titanium lactate solution (0.45 parts by mass) was added to the metal compound-containing layer (gas barrier layer) coating liquid.

Note that the Ti content of the thus formed metal compound-containing layer (gas barrier layer) was found to be 6.3% by mass.

Example 5

A thermoreversible recording medium of Example 5 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, the titanium lactate solution (0.6 parts by mass) was added to the metal compound-containing layer (gas barrier layer) coating liquid.

Note that the Ti content of the thus formed metal compound-containing layer (gas barrier layer) was found to be 8.3% by mass.

Example 6

A thermoreversible recording medium of Example 6 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, the titanium lactate solution (0.75 parts by mass) was added to the metal compound-containing layer (gas barrier layer) coating liquid.

Note that the Ti content of the thus formed metal compound-containing layer (gas barrier layer) was found to be 10.4% by mass.

Example 7

A thermoreversible recording medium of Example 7 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, a zirconium acylate solution (30% zirconium acylate solution, ZB-126, produced by Matsumoto Fine Chemical Co., Ltd.) (0.01 parts by mass) was added to the metal compound-containing layer (gas barrier layer) coating liquid.

Note that the Zr content of the thus formed metal compound-containing layer (gas barrier layer) was found to be 0.2% by mass.

Example 8

A thermoreversible recording medium of Example 8 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, a zirconium acylate solution (0.03 parts by mass) was added to the metal compound-containing layer (gas barrier layer) coating liquid.

Note that the Zr content of the thus formed metal compound-containing layer (gas barrier layer) was found to be 0.9% by mass.

Example 9

A thermoreversible recording medium of Example 9 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, a zirconium acylate solution (0.1 parts by mass) was added to the metal compound-containing layer (gas barrier layer) coating liquid.

Note that the Zr content of the thus formed metal compound-containing layer (gas barrier layer) was found to be 1.9% by mass.

Example 10

A thermoreversible recording medium of Example 10 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, a zirconium acylate solution (0.2 parts by mass) was added to the metal compound-containing layer (gas barrier layer) coating liquid.

Note that the Zr content of the thus formed metal compound-containing layer (gas barrier layer) was found to be 3.8% by mass.

Example 11

A thermoreversible recording medium of Example 11 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, a zirconium acylate solution (0.4 parts by mass) was added to the metal compound-containing layer (gas barrier layer) coating liquid.

Note that the Zr content of the thus formed metal compound-containing layer (gas barrier layer) was found to be 7.5% by mass.

Example 12

A thermoreversible recording medium of Example 12 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, a zirconium acylate solution (0.5 parts by mass) was added to the metal compound-containing layer (gas barrier layer) coating liquid.

Note that the Zr content of the thus formed metal compound-containing layer (gas barrier layer) was found to be 9.4% by mass.

Example 13

A thermoreversible recording medium of Example 13 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, a 80% titanium diisopropoxy-bis(triethanolaminate) solution (TC-400, produced by Matsumoto Fine Chemical Co., Ltd.) (0.45 parts by mass) was added to the metal compound-containing layer (gas barrier layer) coating liquid.

Note that the Ti content of the thus formed metal compound-containing layer (gas barrier layer) was found to be 6% by mass.

Example 14

A thermoreversible recording medium of Example 14 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, a 30% zirconium acetate solution (ZA-30, produced by Daiichi Kigenzo Kagaku Kogyo K.K.) (0.20 parts by mass) was added to the metal compound-containing layer (gas barrier layer) coating liquid.

Note that the Zr content of the thus formed metal compound-containing layer (gas barrier layer) was found to be 6.5% by mass.

Example 15

A thermoreversible recording medium of Example 15 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, a titanium lactate solution (TC-310, produced by Matsumoto Fine Chemical Co., Ltd.) (0.2 parts by mass) was added to the metal compound-containing layer (gas barrier layer) coating liquid, and the zirconium acylate solution (ZB-126, produced by Matsumoto Fine Chemical Co., Ltd.) (0.15 parts by mass) was added thereto Note that the Ti content and the Zr content of the thus formed metal compound-containing layer (gas barrier layer) were found to be 2.8% by mass and 2.8% by mass.

Example 16

A thermoreversible recording medium of Example 16 was produced in the same manner as in Example 4, except that in the formation of metal compound-containing layer (gas barrier layer), the thickness of the metal compound-containing layer (gas barrier layer) was changed from 0.5 μm to 0.05 μm.

Example 17

A thermoreversible recording medium of Example 17 was produced in the same manner as in Example 4, except that in the formation of metal compound-containing layer (gas barrier layer), the thickness of the metal compound-containing layer (gas barrier layer) was changed from 0.5 μm to 0.1 μm.

Example 18

A thermoreversible recording medium of Example 18 was produced in the same manner as in Example 4, except that in the formation of metal compound-containing layer (gas barrier layer), the thickness of the metal compound-containing layer (gas barrier layer) was changed from 0.5 μm to 0.3 μm.

Example 19

A thermoreversible recording medium of Example 19 was produced in the same manner as in Example 4, except that in the formation of metal compound-containing layer (gas barrier layer), the thickness of the metal compound-containing layer (gas barrier layer) was changed from 0.5 μm to 1.0 μm.

Example 20

A thermoreversible recording medium of Example 20 was produced in the same manner as in Example 4, except that in the formation of metal compound-containing layer (gas barrier layer), the thickness of the metal compound-containing layer (gas barrier layer) was changed from 0.5 μm to 3.0 μm.

Example 21

A thermoreversible recording medium of Example 21 was produced in the same manner as in Example 4, except that in the formation of metal compound-containing layer (gas barrier layer), the thickness of the metal compound-containing layer (gas barrier layer) was changed from 0.5 μm to 5.0 μm.

Example 22

A thermoreversible recording medium of Example 22 was produced in the same manner as in Example 4, except that in the formation of metal compound-containing layer (gas barrier layer), the thickness of the metal compound-containing layer (gas barrier layer) was changed from 0.5 μm to 10 μm.

Example 23

A thermoreversible recording medium of Example 23 was produced in the same manner as in Example 4, except that in the formation of metal compound-containing layer (gas barrier layer), the thickness of the metal compound-containing layer (gas barrier layer) was changed from 0.5 μm to 15 μm.

Comparative Example 1

A thermoreversible recording medium of Comparative Example 1 was produced in the same manner as in Example 1, except that in the formation of metal compound-containing layer (gas barrier layer), the titanium lactate solution was not added to the metal compound-containing layer (gas barrier layer) coating liquid.

Comparative Example 2

A thermoreversible recording medium of Comparative Example 2 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, a carbodiimide solution (40% carbodiimide solution, CARBODILITE V04, produced by Nisshinbo Industries, Inc.) (0.015 parts by mass) was added to the metal compound-containing layer (gas barrier layer) coating liquid.

Note that the carbodiimide content of the thus formed gas barrier layer was found to be 1.0% by mass.

Comparative Example 3

A thermoreversible recording medium of Comparative Example 3 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, a carbodiimide solution (40% carbodiimide solution, CARBODILITE V04, produced by Nisshinbo Industries, Inc.) (0.045 parts by mass) was added to the metal compound-containing layer (gas barrier layer) coating liquid.

Note that the carbodiimide content of the thus formed gas barrier layer was found to be 3.0% by mass.

Comparative Example 4

A thermoreversible recording medium of Comparative Example 4 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, a carbodiimide solution (40% carbodiimide solution, CARBODILITE V04, produced by Nisshinbo Industries, Inc.) (0.15 parts by mass) was added to the metal compound-containing layer (gas barrier layer) coating liquid.

Note that the carbodiimide content of the thus formed gas barrier layer was found to be 10% by mass.

Comparative Example 5

A thermoreversible recording medium of Comparative Example 5 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, a carbodiimide solution (40% carbodiimide solution, CARBODILITE V04, produced by Nisshinbo Industries, Inc.) (0.30 parts by mass) was added to the metal compound-containing layer (gas barrier layer) coating liquid.

Note that the carbodiimide content of the thus formed gas barrier layer was found to be 20% by mass.

Comparative Example 6

A thermoreversible recording medium of Comparative Example 6 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, a carbodiimide solution (40% carbodiimide solution, CARBODILITE V04, produced by Nisshinbo Industries, Inc.) (0.60 parts by mass) was added to the metal compound-containing layer (gas barrier layer) coating liquid.

Note that the carbodiimide content of the thus formed gas barrier layer was found to be 40% by mass.

Comparative Example 7

A thermoreversible recording medium of Comparative Example 7 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, a carbodiimide solution (40% carbodiimide solution, CARBODILITE V04, produced by Nisshinbo Industries, Inc.) (0.75 parts by mass) was added to the metal compound-containing layer (gas barrier layer) coating liquid.

Note that the carbodiimide content of the thus formed gas barrier layer was found to be 50% by mass.

Comparative Example 8

A thermoreversible recording medium of Comparative Example 8 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, an oxazoline-based compound-solution (40% oxazoline-based compound solution, EPOCROSS WS-500, produced by Nippon Shokubai Co., Ltd.) (0.015 parts by mass) was added to the metal compound-containing layer (gas barrier layer) coating liquid.

Note that the oxazoline content of the thus formed gas barrier layer was found to be 1.0% by mass.

Comparative Example 9

A thermoreversible recording medium of Comparative Example 9 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, an oxazoline-based compound-solution (40% oxazoline-based compound solution, EPOCROSS WS-500, produced by Nippon Shokubai Co., Ltd.) (0.045 parts by mass) was added to the metal compound-containing layer (gas barrier layer) coating liquid.

Note that the oxazoline content of the thus formed gas barrier layer was found to be 3.0% by mass.

Comparative Example 10

A thermoreversible recording medium of Comparative Example 10 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, an oxazoline-based compound-solution (40% oxazoline-based compound solution, EPOCROSS WS-500, produced by Nippon Shokubai Co., Ltd.) (0.15 parts by mass) was added to the metal compound-containing layer (gas barrier layer) coating liquid.

Note that the oxazoline content of the thus formed gas barrier layer was found to be 10% by mass.

Comparative Example 11

A thermoreversible recording medium of Comparative Example 11 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, an oxazoline-based compound-solution (40% oxazoline-based compound solution, EPOCROSS WS-500, produced by Nippon Shokubai Co., Ltd.) (0.3 parts by mass) was added to the metal compound-containing layer (gas barrier layer) coating liquid.

Note that the oxazoline content of the thus formed gas barrier layer was found to be 20% by mass.

Comparative Example 12

A thermoreversible recording medium of Comparative Example 12 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, an oxazoline-based compound-solution (40% oxazoline-based compound solution, EPOCROSS WS-500, produced by Nippon Shokubai Co., Ltd.) (0.60 parts by mass) was added to the metal compound-containing layer (gas barrier layer) coating liquid.

Note that the oxazoline content of the thus formed gas barrier layer was found to be 40% by mass.

Comparative Example 13

A thermoreversible recording medium of Comparative Example 13 was produced in the same manner as in Example 1, except that in the formation of metal compound-containing layer (gas barrier layer), instead of adding the titanium lactate solution (0.015 parts by mass) into the metal compound-containing layer (gas barrier layer) coating liquid, an oxazoline-based compound-solution (40% oxazoline-based compound solution, EPOCROSS WS-500, produced by Nippon Shokubai Co., Ltd.) (0.75 parts by mass) was added to the metal compound-containing layer (gas barrier layer) coating liquid.

Note that the oxazoline content of the thus formed gas barrier layer was found to be 50% by mass.

(Evaluation of Thermoreversible Recording Medium)

The produced thermoreversible recording media of Examples 1 to 23 and Comparative Examples 1 to 13 were subjected to a durability test, a light resistance test, a water resistance test, and a time-peeling test.

—Durability Test—

On each of these thermoreversible recording media, printing and erasing were repeated 300 times, using a card printer (R-28000, manufactured by Panasonic Communications Inc.). Conditions for the printing and erasing were set as: printing energy: 0.57 mJ/dot, erasing temperature: 130° C., conveying speed: 56 mm/sec. At the time of repeating printing/erasing once, 100 times, and 300 times, the surface of the thermoreversible recording medium was visually observed, and evaluated based on the following evaluation criteria. The evaluation results are shown in Tables 1 to 3.

—Evaluation Criteria—

A: The level at which the colored state of the image portion and the erased state of the erased portion are clean, and no separation of a coated film is observed.

B: The level at which the colored state and the erased state are clean, but separation of a coated film is slightly observed.

C: The level at which a colored image was concealed, slightly opacified in white, and separation of a coated film is observed.

D: The level at which separation of the coated film is severe and the evaluation on repetitive durability test cannot be continued.

Note that "separation of a coated film" means at least one of inner-layer separation of a gas barrier layer and interlayer separation between a gas barrier layer and layers provided adjacent to the gas barrier layer.

—Light Resistance Test—

After printing (printing energy: 0.57 mJ/dot, conveying speed: 56 mm/sec) was carried out on the thermoreversible recording medium by the card printer (R-28000, manufactured by Panasonic Communications Inc.), the thermoreversible recording medium was exposed to light using a xenon lamp ((light exposure test) light irradiation intensity: 120,000 Lx, time: 48 hours, temperature: 35° C., humidity: 80%, artificial sunshine irradiator manufactured by Ceric Co.). After the thermoreversible recording medium was exposed to light, an erasing and printing (rewriting) test was carried out using the same card printer. Conditions for the test were set as: erasing temperature: 130° C., conveying speed: 56 mm/sec, and printing energy: 0.57 mJ/dot. A density and erasure density of the base of each of the thermoreversible recording media were measured by X-RITE 918, and evaluated based on the following evaluation criteria. The evaluation results are shown in Tables 1 to 3.

—Evaluation Criteria—

A: The difference in density between the erased portion and the base is 0.05 or less.

B: The difference in density between the erased portion and the base is 0.20 or less.

C: The difference in density between the erased portion and the base is 0.50 or less.

D: The difference in density between the erased portion and the base is more than 0.50.

—Water Resistance Test—

After printing (printing energy: 0.57 mJ/dot, conveying speed: 56 mm/sec) was carried out on the thermoreversible recording medium by the card printer (R-28000, manufactured by Panasonic Communications Inc.), the thermoreversible recording medium was preserved in water with the temperature adjusted at 22° C. for 24 hours. After the preservation, the image recorded on the thermoreversible recording medium was erased to rewrite another image (the printed image was erased at an erasing temperature of 130° C., and the thermoreversible recording medium was printed again with the card printer (printing energy: 0.57 mJ/dot, conveying speed: 56 mm/sec)). The condition of the image printed on the surface of the thermoreversible recording medium was visually observed and evaluated based on the following evaluation criteria. The evaluation results are shown in Tables 1 to 3.

—Evaluation Criteria—

A: The level at which the colored state of the image portion and the erased state of the erased portion are clean, and no separation of a coated film is observed.

B: The level at which the colored state of and the erased state are clean, but separation of a coated film is slightly observed.

C: The level at which a colored image was concealed, slightly opacified in white, and separation of a coated film is observed.
D: The level at which separation of the coated film is severe and the evaluation on repetitive durability test cannot be continued.

Note that "separation of a coated film" means at least one of inner-layer separation of a gas barrier layer and interlayer separation between a gas barrier layer and layers provided adjacent to the gas barrier layer.

—Time Peeling Test (Normal Temperature/Normal Humidity)—

After printing (printing energy: 0.57 mJ/dot, conveying speed: 56 mm/sec) was carried out on the thermoreversible recording medium by the card printer (R-28000, manufactured by Panasonic Communications Inc.), the thermoreversible recording medium was preserved at normal temperature and a humidity of 50% for 1 day, for one-week, and for one month. After the preservation, the image recorded on the thermoreversible recording medium was erased to rewrite another image (the printed image was erased at an erasing temperature of 130° C., and the thermoreversible recording medium was printed again with the card printer (printing energy: 0.57 mJ/dot, conveying speed: 56 mm/sec)). The condition of the image printed on the surface of the thermoreversible recording medium was visually observed and evaluated based on the following evaluation criteria.

—Evaluation Criteria—

A: The level at which the colored state of the image portion and the erased state of the erased portion are clean, and no separation of a coated film is observed.
B: The level at which the colored state of and the erased state are clean, but separation of a coated film is slightly observed.
C: The level at which a colored image was concealed, slightly opacified in white, and separation of a coated film is observed.
D: The level at which separation of the coated film is severe and the evaluation on repetitive durability test cannot be continued.

Note that "separation of a coated film" means at least one of inner-layer separation of a gas barrier layer and interlayer separation between a gas barrier layer and layers provided adjacent to the gas barrier layer.

—Time Peeling Test (High Temperature/High Humidity)—

After printing (printing energy: 0.57 mJ/dot, conveying speed: 56 mm/sec) was carried out on the thermoreversible recording medium by the card printer (R-28000, manufactured by Panasonic Communications Inc.), the thermoreversible recording medium was preserved at a temperature of 40° C. and a humidity of 90% for 1 day, for one-week, and for one month. After the preservation, the image recorded on the thermoreversible recording medium was erased to rewrite another image (the printed image was erased at an erasing temperature of 130° C., and the thermoreversible recording medium was printed again with the card printer (printing energy: 0.57 mJ/dot, conveying speed: 56 mm/sec)). The condition of the image printed on the surface of the thermoreversible recording medium was visually observed and evaluated based on the following evaluation criteria.

—Evaluation Criteria—

A: The level at which the colored state of the image portion and the erased state of the erased portion are clean, and no separation of a coated film is observed.
B: The level at which the colored state of and the erased state are clean, but separation of a coated film is slightly observed.
C: The level at which a colored image was concealed, slightly opacified in white, and separation of a coated film is observed.
D: The level at which separation of the coated film is severe and the evaluation on repetitive durability test cannot be continued.

TABLE 1

| | Durability test | | | Water resistance test After stored for 24 hr | Time peeling test (normal temperature/normal humidity) | | | Time peeling test (highl temperature/high humidity) | | | Light resistance test | |
|---|---|---|---|---|---|---|---|---|---|---|---|---|
| | One time | 100 times | 300 times | | 1 day | 1 week | 1 month | 1 day | 1 week | 1 month | Density of erased portion-Density of base portion | Evaluation result |
| Ex. 1 | A | B | C | C | A | B | C | B | C | C | 0.01 | A |
| Ex. 2 | A | A | B | A | A | A | A | A | A | B | 0.01 | A |
| Ex. 3 | A | A | A | A | A | A | A | A | A | A | 0.03 | A |
| Ex. 4 | A | A | A | A | A | A | A | A | A | A | 0.04 | A |
| Ex. 5 | A | A | A | A | A | A | A | A | A | A | 0.13 | B |
| Ex. 6 | A | A | A | A | A | A | A | A | A | A | 0.45 | C |
| Ex. 7 | A | B | C | C | A | B | C | B | C | C | 0.01 | A |
| Ex. 8 | A | A | B | B | A | A | B | A | B | B | 0.01 | A |
| Ex. 9 | A | A | B | B | A | A | A | A | A | B | 0.02 | A |
| Ex. 10 | A | A | B | B | A | A | A | A | A | B | 0.03 | A |
| Ex. 11 | A | A | A | A | A | A | A | A | A | A | 0.13 | B |
| Ex. 12 | A | A | A | A | A | A | A | A | A | A | 0.35 | C |
| Ex. 13 | A | B | B | B | B | B | C | B | C | C | 0.01 | A |
| Ex. 14 | A | A | A | A | A | A | A | A | B | B | 0.03 | A |
| Ex. 15 | A | A | A | A | A | A | A | A | A | A | 0.03 | A |

TABLE 2

| | Durability test | | | Water resistance test After stored for 24 hr | Time peeling test (normal temperature/ normal humidity) | | | Time peeling test (highl temperature/ high humidity | | | Light resistance test Density of erased portion-Density of base portion | Evaluation result |
|---|---|---|---|---|---|---|---|---|---|---|---|---|
| | One time | 100 times | 300 times | | 1 day | 1 week | 1 month | 1 day | 1 week | 1 month | | |
| Ex. 16 | A | A | A | A | A | A | A | A | A | A | 0.46 | C |
| Ex. 17 | A | A | A | A | A | A | A | A | A | A | 0.09 | B |
| Ex. 18 | A | A | A | A | A | A | A | A | A | A | 0.04 | A |
| Ex. 19 | A | A | A | A | A | A | A | A | A | A | 0.02 | A |
| Ex. 20 | A | A | A | A | A | A | A | A | A | A | 0.01 | A |
| Ex. 21 | A | A | A | A | A | A | A | A | A | A | 0.01 | A |
| Ex. 22 | A | A | A | A | A | A | A | A | A | A | 0.01 | A |
| Ex. 23 | A | A | A | A | A | A | A | A | A | A | 0.01 | A |

TABLE 3

| | Durability test | | | Water resistance test After stored for 24 hr | Time peeling test (normal temperature/ normal humidity) | | | Time peeling test (high temperature/ high humidity) | | | Light resistance test Density of erased portion-Density of base portion | Evaluation result |
|---|---|---|---|---|---|---|---|---|---|---|---|---|
| | One time | 100 times | 300 times | | 1 day | 1 week | 1 month | 1 day | 1 week | 1 month | | |
| Comp. Ex. 1 | A | D | D | D | A | B | D | B | D | D | 0.01 | A |
| Comp. Ex. 2 | A | D | D | D | A | B | D | B | D | D | 0.01 | A |
| Comp. Ex. 3 | A | D | D | D | A | B | D | B | D | D | 0.01 | A |
| Comp. Ex. 4 | A | D | D | D | A | B | D | B | D | D | 0.01 | A |
| Comp. Ex. 5 | A | D | D | D | A | B | D | B | D | D | 0.08 | B |
| Comp. Ex. 6 | A | C | D | C | A | B | D | B | D | D | 0.25 | C |
| Comp. Ex. 7 | A | C | D | C | A | B | D | B | D | D | 0.5 | C |
| Comp. Ex. 8 | A | D | D | D | A | B | D | B | D | D | 0.01 | A |
| Comp. Ex. 9 | A | B | D | D | A | B | D | B | D | D | 0.01 | A |
| Comp. Ex. 10 | A | B | C | C | A | A | B | B | D | D | 0.03 | A |
| Comp. Ex. 11 | A | B | B | C | A | A | B | B | D | D | 0.08 | B |
| Comp. Ex. 12 | A | A | A | C | A | A | A | B | C | D | 0.21 | C |
| Comp. Ex. 13 | A | A | A | C | A | A | A | B | C | D | 0.68 | D |

As is clear from the results of Examples 1 to 23, the thermoreversible recording media of the present invention were capable of preventing the occurrence of inter-layer separation of the metal compound-containing layer (gas barrier layer) and interlayer separation between the metal compound-containing layer and other layers and maintaining a high definition image even when used for a long time under strict conditions of repeating of printing and erasing 300 times, 48-hr-light exposure under high temperature and high humidity conditions, immersion in water for 24 hours, and storage test under high temperature-high humidity conditions for 1 month.

The thermoreversible recording medium and the thermoreversible recording member of the present invention can be suitably used as output paper for facsimiles, word processors, and scientific instruments, and commutation tickets for transportation means, magnetic cards (e.g., various pre-paid cards, and loyalty point cards), IC cards, and IC tags.

What is claimed is:

1. A thermoreversible recording medium comprising:

a support, a thermoreversible recording layer which comprises a thermoreversible composition containing an electron-donating color-forming compound and an electron-accepting compound, a metal compound-containing layer which comprises a resin, an organic metal compound, and an inorganic layer compound, in which the resin is at least one selected from the group consisting of polyvinyl alcohol polymers, and ethylene-vinyl alcohol copolymers, and the organic metal compound is at least one selected from the group consisting of an organic titanium compound and an organic zirconium compound, and a protective layer which protects the metal compound containing layer, wherein the support, the thermoreversible recording layer, the metal compound-containing layer and the protective layer are laminated in this order, the inorganic layer compound is dispersed in the metal compound-containing layer in a plate shape having a length of from 5 nm to 5,000 nm, and having a thickness of about 1/10 to about 1/10,000 the length thereof, and the organic titanium compound is a titanium chelate compound or titanium acylate compound and the organic zirconium compound is a zirconium chelate compound or zirconium acylate compound.

2. The thermoreversible recording medium according to claim 1, wherein the amount of metal contained in the metal compound-containing layer is 0.1% by mass to 15% by mass.

3. The thermoreversible recording medium according to claim 1, wherein the metal compound-containing layer has a thickness of 0.1 μm to 10 μm.

4. The thermoreversible recording medium according to claim 1, wherein the organic metal compound contains at least one of a chelate compound and an acylate compound.

5. The thermoreversible recording medium according to claim 1, further comprising: a thermosetting resin-containing layer between the metal compound-containing layer and the protective layer, wherein the thermosetting resin-containing layer contains a hardened material made of a thermosetting resin composition.

6. The thermoreversible recording medium according to claim 1, further comprising: an undercoat layer between the support and the thermoreversible recording layer.

7. The thermoreversible recording medium according to claim 1, wherein the titanium chelate compound has the formula $Ti(OR)_n(X)_{4-n}$, wherein R is an organic group, X is a ligand, and n is an integer of 0 to 3, the titanium acylate compound has the formula: $Ti(OR^1)_n(OCOR^2)_{4-n}$, wherein $R^1$ is an organic group, $R^2$ is an organic group, n is an integer of 0 to 3, the zirconium chelate compound has the formula $Zr(OR)_n(X)_{4-n}$ wherein R is an organic group, X is a ligand, n is an integer of 0 to 3, and zirconium acylate compound $Zr(OR^1)_n(OCOR^2)_{4-n}$, wherein $R^1$ is an organic group, $R^2$ is an organic group, n is an integer of 0 to 3.

8. A thermoreversible recording member comprising:

an information storage unit, and a reversible display unit, wherein the reversible display unit includes a thermoreversible recording medium which comprises:

a support, a thermoreversible recording layer which comprises a thermoreversible composition containing an electron-donating color-forming compound and an electron-accepting compound, a metal compound-containing layer which comprises a resin, an organic metal compound, and an inorganic layer compound, in which the resin is at least one selected from the group consisting of polyvinyl alcohol polymers, and ethylene-vinyl alcohol copolymers, and the organic metal compound is at least one selected from the group consisting of an organic titanium compound and an organic zirconium compound, and a protective layer which protects the metal compound containing layer, and wherein the support, the thermoreversible recording layer, the metal compound-containing layer and the protective layer are laminated in this order, the inorganic layer compound is dispersed in the metal compound-containing layer in a late shape having a length of from 5 nm to 5,000 nm, and having a thickness of about 1/10 to about 1/10,000 the length thereof, and the organic titanium compound is a titanium chelate compound or titanium ac late compound and the organic zirconium compound is a zirconium chelate compound or zirconium acylate compound.

9. The thermoreversible recording member according to claim 8, wherein the amount of metal contained in the metal compound-containing layer is 0.1% by mass to 15% by mass.

10. The thermoreversible recording member according to claim 8, wherein the metal compound-containing layer has a thickness of 0.1 μm to 10 μm.

11. The thermoreversible recording member according to claim 8, wherein the organic metal compound contains at least one of a chelate compound and an acylate compound.

12. The thermoreversible recording member according to claim 8, further comprising: a thermosetting resin-containing layer between the metal compound-containing layer and the protective layer, wherein the thermosetting resin-containing layer contains a hardened material made of a thermosetting resin composition.

13. The thermoreversible recording member according to claim 8, further comprising: an undercoat layer between the support and the thermoreversible recording layer.

14. The thermoreversible recording member according to claim 8, wherein the information storage unit includes at least one selected from a magnetic thermosensitive recording layer, a magnetic stripe, an IC memory, an optical memory, a hologram, an RF-ID tag card, a disk, a disk cartridge, and a tape cassette.

* * * * *